US008784232B2

(12) United States Patent
Jertson et al.

(10) Patent No.: US 8,784,232 B2
(45) **Date of Patent: *Jul. 22, 2014**

(54) GOLF CLUB HEADS AND METHODS TO MANUFACTURE THE SAME

(75) Inventors: Marty R. Jertson, Cave Creek, AZ (US); Eric J. Morales, Laveen, AZ (US); Bradley D. Schweigert, Anthem, AZ (US); Anthony D. Serrano, New River, AZ (US); Michael R. Nicolette, Scottsdale, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 572 days.

This patent is subject to a terminal disclaimer.

(21) Appl. No.: 13/089,240

(22) Filed: Apr. 18, 2011

(65) Prior Publication Data

US 2011/0212795 A1 Sep. 1, 2011

Related U.S. Application Data

(63) Continuation-in-part of application No. 12/202,060, filed on Aug. 29, 2008, now Pat. No. 7,927,229.

(60) Provisional application No. 61/969,021, filed on Aug. 30, 2007.

(51) Int. Cl.
*A63B 53/04* (2006.01)
*A63B 53/06* (2006.01)

(52) U.S. Cl.
USPC ..... 473/324; 473/335; 473/338; 473/345; 473/349

(58) Field of Classification Search
USPC ..... 473/324–350, 287–292
See application file for complete search history.

(56) References Cited

U.S. PATENT DOCUMENTS

| | | | | |
|---|---|---|---|---|
| 1,306,029 | A * | 6/1919 | Robertson | 473/338 |
| 1,319,233 | A * | 10/1919 | Mattern | 473/337 |
| 1,509,429 | A * | 9/1924 | Hillerich | 473/342 |
| 1,913,821 | A * | 6/1933 | Stumpf | 473/338 |
| 5,518,243 | A * | 5/1996 | Redman | 473/334 |
| 5,807,188 | A * | 9/1998 | Serrano et al. | 473/338 |
| 6,012,990 | A * | 1/2000 | Nishizawa | 473/345 |
| 6,062,988 | A * | 5/2000 | Yamamoto | 473/324 |
| 6,306,048 | B1 * | 10/2001 | McCabe et al. | 473/333 |
| 7,166,040 | B2 * | 1/2007 | Hoffman et al. | 473/334 |
| 7,247,103 | B2 * | 7/2007 | Beach et al. | 473/324 |
| 7,303,487 | B2 * | 12/2007 | Kumamoto | 473/345 |
| 7,316,624 | B2 * | 1/2008 | Sanchez | 473/345 |
| 7,611,424 | B2 * | 11/2009 | Nagai et al. | 473/334 |
| 7,927,229 | B2 * | 4/2011 | Jertson et al. | 473/324 |
| 2011/0053705 | A1 * | 3/2011 | Stites | 473/334 |

* cited by examiner

*Primary Examiner* — Sebastiano Passaniti

(57) ABSTRACT

Embodiments of golf club heads and methods to manufacture golf club heads are disclosed herein. Other examples and related methods are also generally described herein.

20 Claims, 13 Drawing Sheets

GOLF CLUB HEADS AND METHODS TO MANUFACTURE THE SAME

CROSS REFERENCE TO RELATED APPLICATIONS

This patent application is a continuation-in-part of U.S. patent application Ser. No. 12/202,060, filed Aug. 29, 2008, which claims priority to U.S. Provisional Patent Application No. 61/969,021, filed Aug. 30, 2007. The disclosures of the applications referenced above are incorporated herein by reference.

TECHNICAL FIELD

The present disclosure relates generally to golf equipment, and more particularly, to golf club heads and methods to manufacture golf club heads.

BACKGROUND

To join two pieces of metal together, various techniques and processes such as brazing, adhesive bonding, mechanical bonding (e.g., bolting), soldering, and/or welding can be used. For some applications, high-quality consumer products such as golf clubs, brazing processes can be more advantageous than other bonding techniques and processes. With the ability to join two dissimilar metals (e.g., steel and titanium), brazing processes can provide more material options for product designs. Having the ability to join two dissimilar materials allows lighter or heavier materials to be joined together, thereby allowing a product's designer to have greater design options to tailor a product's performance characteristics, for example, the center of gravity and/or moment of inertia of a golf club head. Typically, a brazed joint can provide a well-finished, clean appearance of the two joined pieces of metal (e.g., a brazed joint may not require additional grinding or finishing). In contrast to other bonding techniques and processes, brazing processes may result with less burn through, if any, in thin-wall structures (e.g., sheet metal). Further, a brazed joint can withstand severe vibration and shock better than other types of joints because the brazed joint is typically stronger than the two pieces of metal being bonded together. Thus, brazing processes can be well-suited for manufacturing golf club heads.

Figure 1:
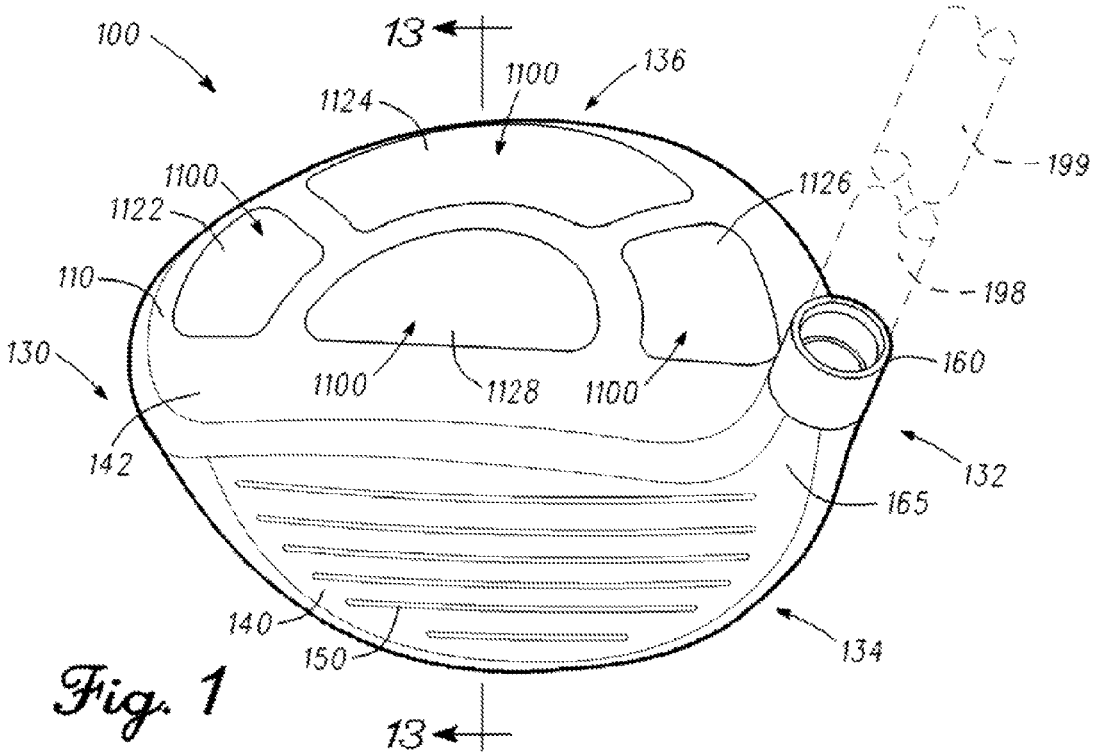
FIG. 1 depicts a top perspective view of an exemplary golf club head according to an embodiment of the methods, apparatuses, and articles of manufacture described herein.

For simplicity and clarity of illustration, the drawing figures illustrate the general manner of construction. Descriptions and details of well-known features and techniques can be omitted to avoid unnecessarily obscuring a golf club method and article. Additionally, elements in the drawing figures are not necessarily drawn to scale. For example, the dimensions of some of the elements in the figures can be exaggerated relative to other elements to help improve understanding of the various exemplary embodiments of a golf club head and method of manufacture. When used, the same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the exemplary embodiments of a golf club head and method of manufacture described herein are, for example, capable of operation in sequences other than those illustrated or otherwise described herein. Furthermore, the terms "contain," "include," and "have," and any variations thereof, are intended to cover a non-exclusive inclusion, such that a process, method, article, or apparatus that comprises a list of elements is not necessarily limited to those elements, but can include other elements not expressly listed or inherent to such process, method, system, article, or apparatus.

The terms "left," "right," "front," "back," "top," "bottom," "side," "under," and the like in the description and in the claims, if any, are used for descriptive purposes and not necessarily for describing permanent relative positions. It is to be understood that the terms so used are interchangeable under appropriate circumstances such that the embodiments of a golf club head and method of manufacture described herein are, for example, capable of operation in other orientations than those illustrated or otherwise described herein. The term "coupled," as used herein, is defined as directly or indirectly connected in a physical, mechanical, or other manner.

DESCRIPTION

In general, methods, apparatuses, and articles of manufacture associated with golf clubs, and in particular golf club heads are described herein. The methods, apparatuses, and articles of manufacture described herein are not limited in this regard.

Figure 2:
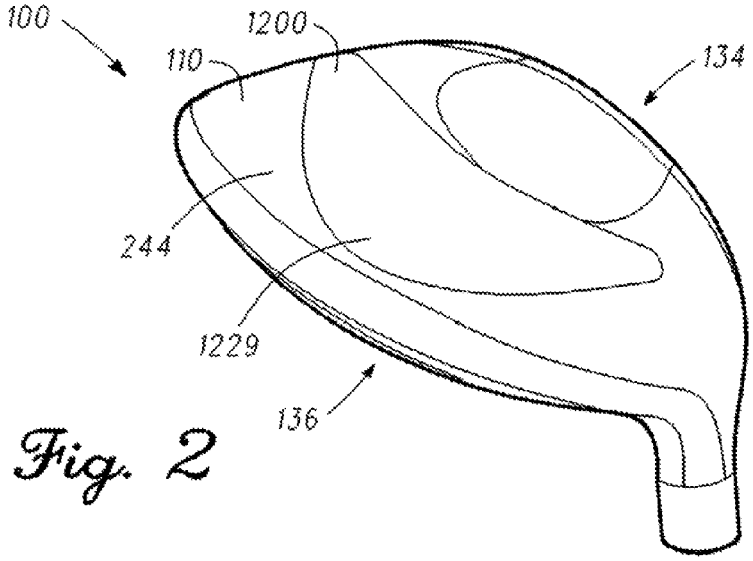
FIG. 2 depicts a bottom perspective view of the exemplary golf club head of FIG. 1.
Figure 3:
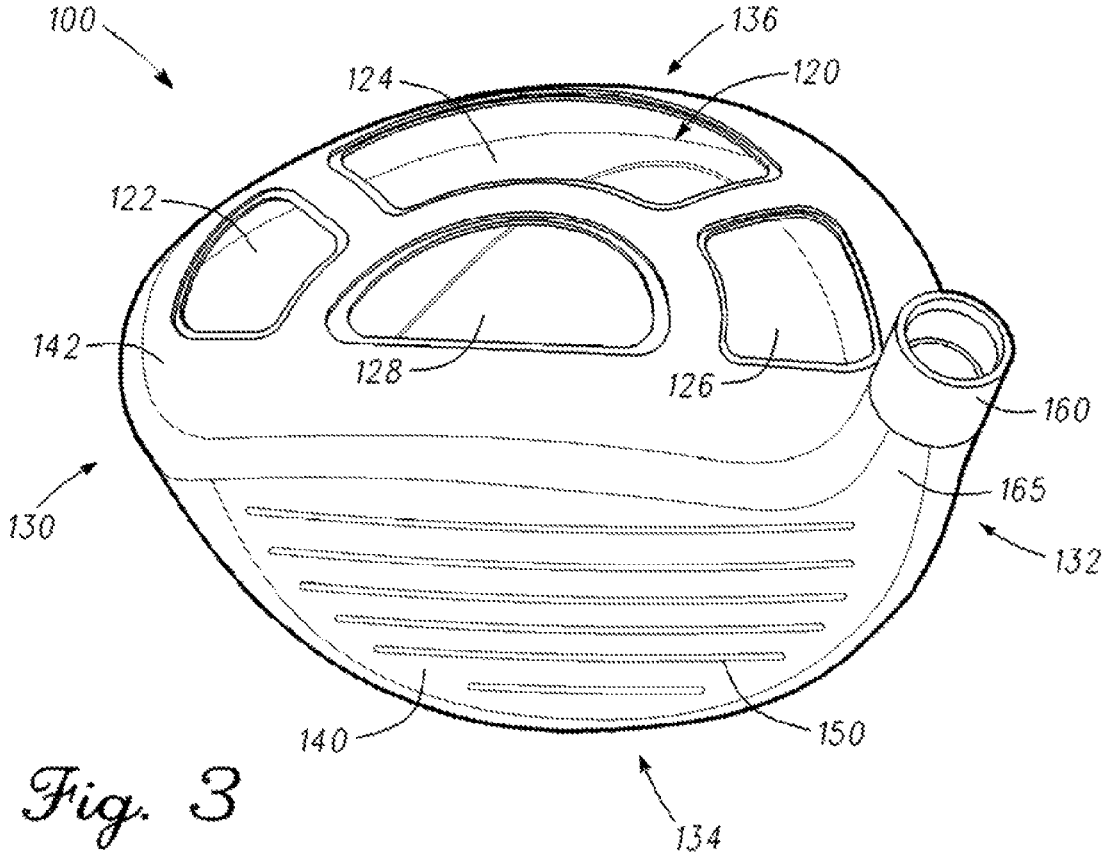
FIG. 3 depicts a top perspective view of an exemplary hollow body of the exemplary golf club head of FIG. 1.
Figure 4:
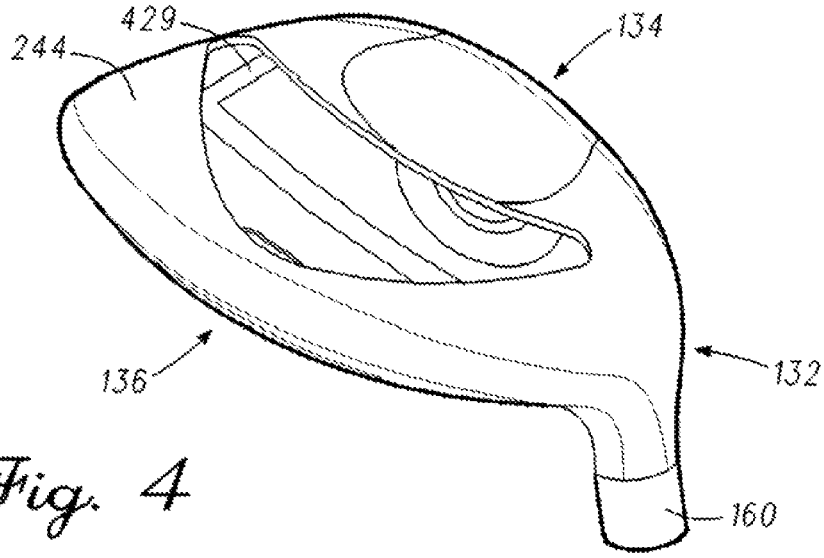
FIG. 4 depicts a bottom perspective view of the exemplary hollow body of FIG. 3.
Figure 5:
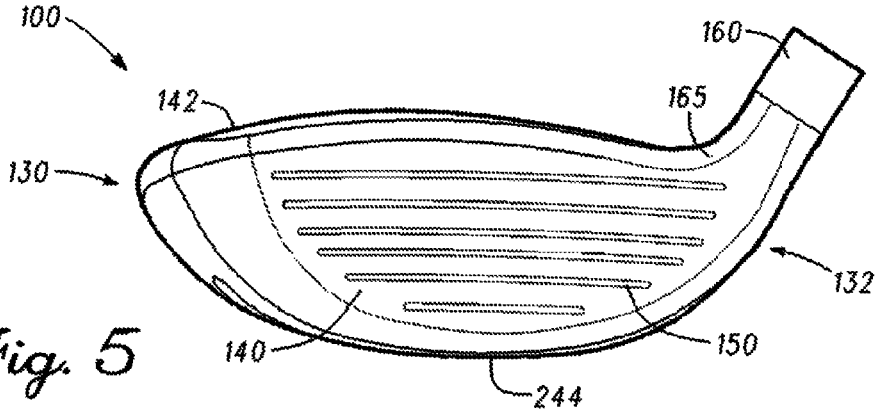
FIG. 5 depicts a front view of the exemplary hollow body of FIG. 3.
Figure 6:
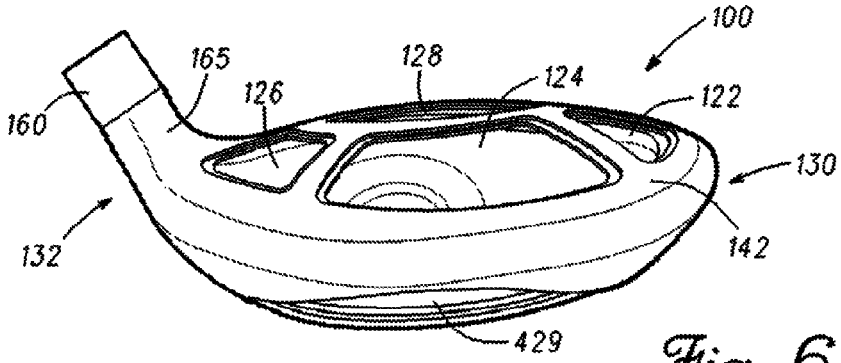
FIG. 6 depicts a back view of the exemplary hollow body of FIG. 3.
Figure 7:
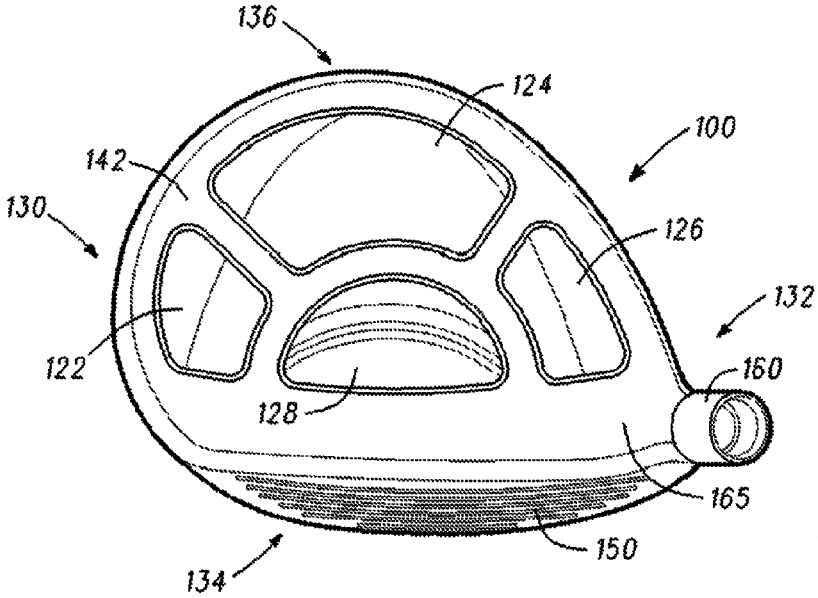
FIG. 7 depicts a top view of the exemplary hollow body of FIG. 3.
Figure 8:
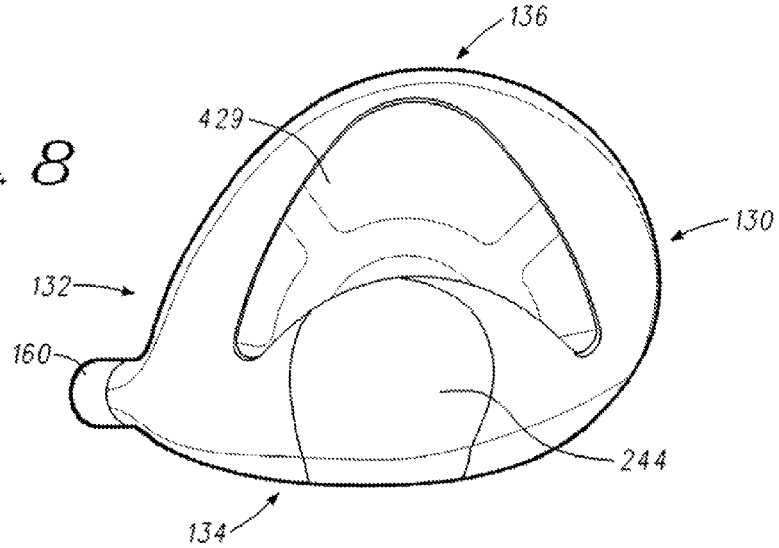
FIG. 8 depicts a bottom view of the exemplary hollow body of FIG. 3.
Figure 9:
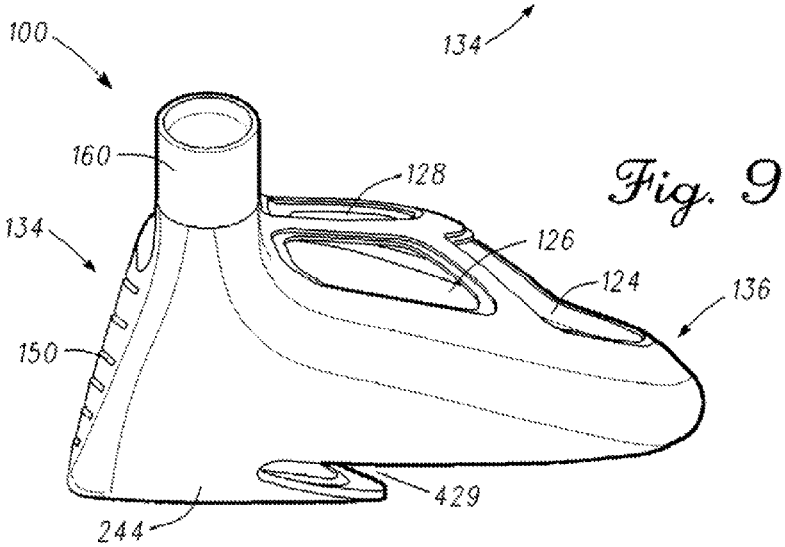
FIG. 9 depicts a heel end view of the exemplary hollow body of FIG. 3.
Figure 10:
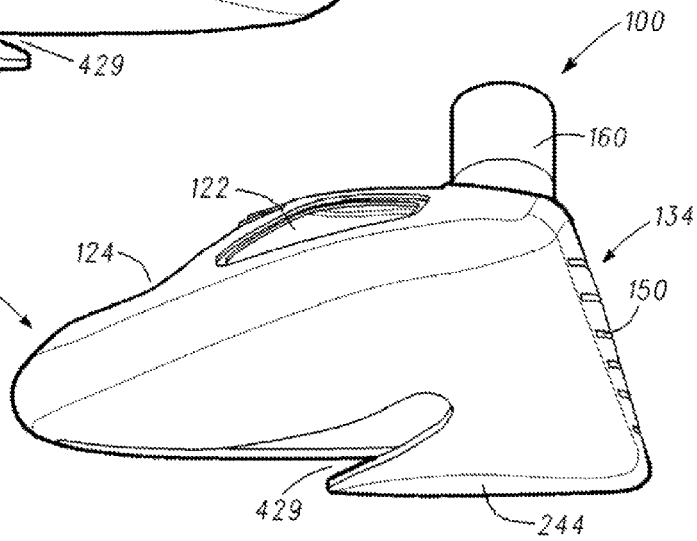
FIG. 10 depicts a toe end view of the exemplary hollow body of FIG. 3.

In an exemplary embodiment shown in FIGS. 1 and 2, golf club head 100 can include body 110. Body 110 can be a hollow body. Body 110 can be made of a metal material such as stainless steel, aluminum, tungsten, magnesium, nickel alloy (i.e., tungsten nickel), titanium, titanium alloy, and/or any other suitable materials. Body 110 can include toe end 130, heel end 132, front end 134, back end 136, face portion 140, top wall portion 142 (e.g., a crown), and bottom wall portion 244 (e.g., a sole). In certain embodiments, body 110 can include one or more apertures 120 or top openings, such as openings 122, 124, 126, and 128 in FIG. 3. An exemplary golf club head as discussed herein can also comprise an aperture or front opening, such as opening 1820 in FIG. 18. Opening 1820 can be located at front end 1734 of hollow body 1710 and can extend between and/or from toe end 1730 to heel end 1732. An exemplary golf club head as discussed herein can further comprise an aperture or bottom opening, such as opening 429 FIG. 4. Another exemplary bottom opening can comprise opening 2720 in FIG. 27. Exemplary opening 2720 can be located between a front end 2634 and a back end 2736 of a hollow body 2610 (FIG. 26) and extend between a toe end 2630 and a heel end 2632. As described in further detail below, the various openings or apertures discussed herein can include one or more openings, holes, slits, gaps, etc. or any combination thereof.

Turning back to FIG. 1, body 110 can comprise toe end 130 opposite of heel end 132. In a similar manner, front end 134 can be opposite of back end 136. Face portion 140 can be located at front end 134 and configured to impact a golf ball (not shown). In particular, face portion 140 can include plurality of grooves 150. Plurality of grooves 150 can be elongated in a direction between toe end 130 and heel end 132 at face portion 140. Top wall portion 142 can be opposite of bottom wall portion 244 (FIG. 2).

Golf club head 100 can also include hosel 160 and hosel transition 165. For example, hosel 160 can be located at or proximate to heel end 132. Hosel 160 can extend from body 110 via hosel transition 165. To form a golf club, hosel 160 can receive a first end of shaft 198. Shaft 198 can be secured to golf club head 100 by an adhesive bonding process (e.g., epoxy) and/or other suitable bonding processes (e.g., mechanical bonding, soldering, welding, and/or brazing). Further, grip 199 can be secured to a second end of shaft 198 to complete the golf club. The apparatus, methods, and articles of manufacture described herein are not limited in this regard.

While various portions and/or surfaces of golf club heads are described herein, golf club heads may not include certain portions and/or surfaces. For example, although one or more of the exemplary golf club head described herein may depict a top wall portion transitioning directly to a bottom wall portion, the golf club head can include a separate side wall portion (e.g., a skirt). In particular, the side wall portion can be located between the top wall portion and the bottom wall portion, and wrap around the back end of the golf club head from the toe end to the heel end. Further, while one or more of the exemplary golf club head described herein can depict the hosel and the hosel transition, the exemplary golf club heads may not include the hosel and/or the hosel transition. For example, golf club head can include a bore (not shown) within the body to receive a shaft (e.g., an opening of the bore can be flushed with the top wall portion). The methods, apparatuses, and articles of manufacture described herein are not limited this regard.

Golf club heads can provide greater forgiveness at off-center hits by adjusting the center of gravity (CG) and/or the moment of inertia (MOI) of the golf club heads. For example, as shown in FIGS. 3, 6, 7, 9, and 10, body 110 can include one or more apertures (e.g., 122, 124, 126, and 128) formed at top wall portion 142 of body 110 and, as will be discussed in greater detail later, can be replaced, covered, or filled with inserts comprising a different density material than the material of top wall portion 142. This and other designs described herein permits much more discretionary weight in the golf club head. As a result, the center of gravity can be optimally lowered and/or otherwise adjusted or located closer to or further away from the front face of the club head. Also, the moment of inertia can be increased. As an example, lowering the center of gravity and moving the it closer to the front face in a fairway wood will increase the ball velocity, increase the ball launch angle, lower the ball spin rate, and improve the feel of the golf club, among other advantages. As another example, moving the center of gravity further away from the front face can increase the ball spin rate, which can be beneficial in certain situations. The apertures in the crown of the club head can help to achieve these advantages while maintaining the strength and structure of the crown vibrations to control the sound of the club head upon impact with the ball.

In the same or different embodiment, as shown in FIGS. 4, 6, 8, 9, and 10, body 110 can include one or more apertures or openings at sole 244 and fitted with a different density insert material to alter the weight of sole 244 to also lower or otherwise adjust or locate the CG and MOI. In the same or different embodiment, body 110 can include one or more apertures or openings at face portion 140 and fitted with a different density material for face portion 140 to alter the weight of face portion 140 to likewise adjust the CG and MOI. For similar reasons, hosel 160 and/or hosel transition 165 can also be made of a lower density material that is the same as or similar to the material used for the inserts, other than the insert at sole 244, and the skirt (if present in the golf club head) can be made of the same or similar higher density material used for the insert at sole 244.

In certain embodiments, body 110 can comprise various combinations of apertures and aperture inserts. For example, body 110 can include different density top wall inserts and a different density sole insert, but the face portion 140 can retain the same density material as the body 110. In another example, body 110 can include different density inserts; at face portion 140, sole 244, and top wall 142. In yet another example, body 110 can also comprise different density inserts at face portion 140 and top wall 142, but, sole 244 retains the same density material as the body 110. Thus, various permutations for replacing the body 110 material with different density material can serve to adjust and/or customize the CG or MOI of body 110. Among the various embodiments, the inserts discussed herein can have densities greater or less than the material density of body 110. Moreover, in still yet other examples, the different density inserts can comprise different densities between them. For example, in an embodiment, body 110 can comprise a material having one density, top wall 142 insert(s) material having a second density, face portion material 140 having a third density, and sole 244 material having a fourth density. In this manner, various other permutations for replacing the material of body 110 with different density material can also serve to adjust and/or customize the CG or MOI of body 110.

Figure 11:
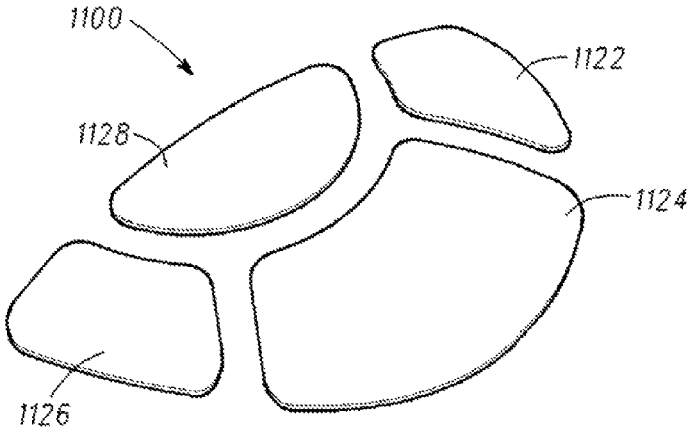
FIG. 11 depicts a top perspective view of exemplary inserts associated with the exemplary golf club head of FIG. 1.
Figure 12:
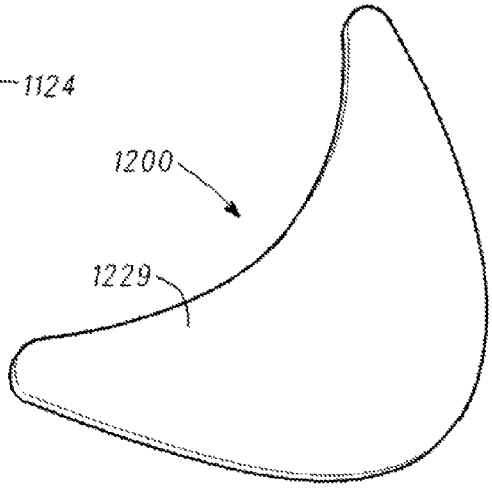
FIG. 12 depicts a top perspective view of an exemplary sole weight associated with the exemplary golf club head of FIGS. 1 and 2.

To form golf club head 100, apertures 120 can be enclosed by one or more inserts 1100, generally shown as inserts 1122, 1124, 1126, and 1128 in FIGS. 1 and 11, and one or more inserts 1200, generally shown as insert 1229 in FIGS. 2 and 12. In one example, as shown in FIG. 1, insert 1122 can enclose, cover, fill, or otherwise be located in aperture 122; insert 1124 can enclose, cover, fill, or otherwise be located in aperture 124; insert 1126 can enclose, cover, fill, or otherwise be located in aperture 126; and insert 1128 can enclose, cover, fill, or otherwise be located in aperture 128. As used herein, the phrase "located in" can include being located over. In a similar manner, insert 1229 can enclose, cover, fill, or otherwise be located in aperture 429 of body 110, as shown in FIG. 2. To redistribute weight from top wall portion 142 of the body 110, inserts 1122, 1124, 1126, and 1128 can be a relatively light-weight metal material. In one example, insert 1229 can be the same metal material or another relatively light-weight metal material. Alternatively, insert 1229 can be a relatively heavier metal material than inserts 1122, 1124, 1126, and 1128 to provide weight at or proximate to bottom wall portion 244 of the body 110.

Throughout this description, although a metal wood-type club head is discussed, the methods, apparatuses, and articles of manufacture described herein can be readily applicable to other suitable type of golf club heads. For example, the methods, apparatuses, and articles of manufacture described herein can be applicable to drivers, fairway woods, hybrids, and putter club heads, or other suitable type of golf club heads. The methods, apparatuses, and articles of manufacture are not limited in this regard.

Figure 13:
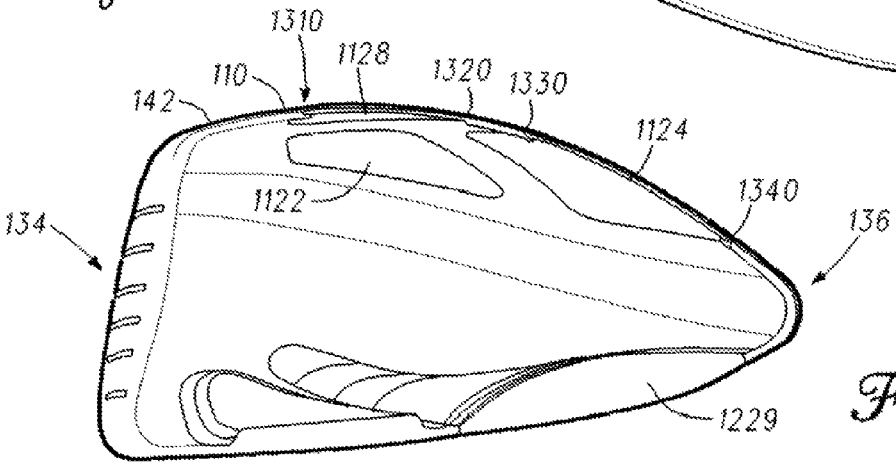
FIG. 13 depicts a cross section view along line 13-13 in FIG. 1 of the exemplary golf club head of FIG. 1.
Figure 14:
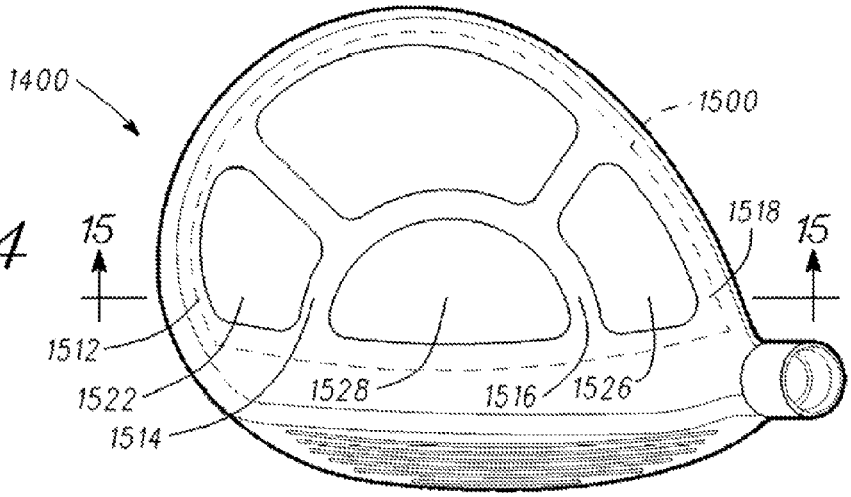
FIG. 14 depicts a top view of another exemplary golf club head according to an embodiment of the methods, apparatuses, and articles of manufacture described herein.

Among the exemplary embodiments discussed herein, brazing processes can be suited to join two dissimilar pieces of metal together, e.g., metals having two different densities. Accordingly, brazing processes can be used to join body 110 and inserts 1100 together. In one example, body 110 can be made of a first metal material such as a stainless steel whereas inserts 1100 can be made of a second metal material such as a titanium-based metal. Turning to FIGS. 13 and 14, for example, body 110 and inserts 1100 and 1229 can be joined together by brazed joints, generally shown as joints 1310, 1320, 1330, and 1340, made of a filler or a third metal such as a copper-based metal and/or other suitable materials (e.g., tin, zinc, silver, etc.).

In addition to joining to dissimilar metals together, brazing processes can also provide a well-finished, clean appearance of body 110 and inserts 1100 at joints 1310, 1320, 1330, and 1340 (e.g., additional grinding or finishing may not be necessary). Further, some portions of body 110 (e.g., the top wall portion 142) can be thin-walled structures. Thus, brazing processes can be suitable to join inserts 1100 (FIG. 11) to body 110 because brazing processes can result in less burn through of the thin-walled structures of body 110 than other bonding processes. Further, joints 1310, 1320, 1330, and 1340 can withstand severe vibration and shock because joints 1310, 1320, 1330, and 1340 can be stronger than the two pieces of metal being bonded together (e.g., body 110 and inserts 1100). In one embodiment, joints 1301, 1320, 1330, and 1340 are located away from high stress areas in the golf club head, as predicted by computer modeling.

Figure 15:
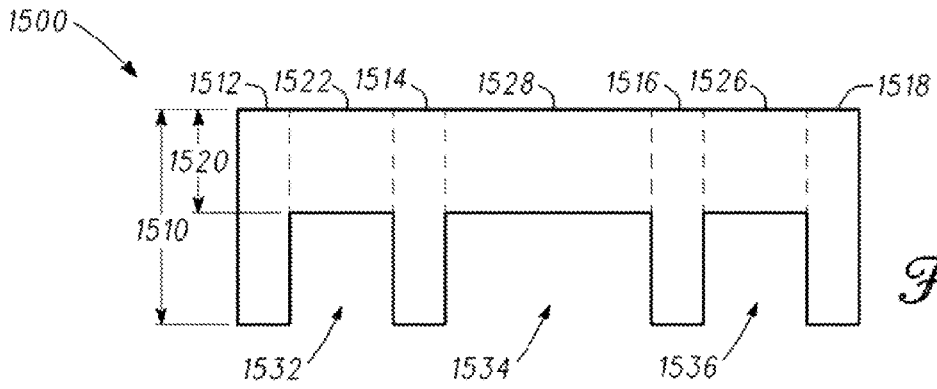
FIG. 15 depicts a cross section view along line 15-15 in FIG. 14 of an exemplary insert of the golf club head of FIG. 14.

Instead of having multiple apertures enclosed with multiple pieces of inserts, a golf club head can include an aperture enclosed by a single-piece insert with one or more relatively thin portions. In particular, the single insert can include a particular pattern to provide structural integrity and optimal vibration and acoustic feedback. Referring to FIGS. 14 and 15, for example, golf club head 1400 can include single-piece insert 1500 with variable thickness. For example, single-piece insert 1500 can include D-shaped configuration, as shown in FIG. 14. Single-piece insert 1500 can include at least one first thickness portion, generally shown as portions 1512, 1514, 1516, and 1518, and at least one second thickness portion, generally shown as portions 1522, 1526, and 1528. In the illustrated embodiment, portions 1522, 1526, and 1528 are located between portions 1512, 1514, 1516, and 1518. First thickness portion(s) 1512, 1514, 1516, and 1518 can be associated with first thickness 1510 whereas second thickness portion(s) 1522, 1526, and 1528 can be associated with second thickness 1520. First thickness portion(s) 1512, 1514, 1516, and 1518 can be relatively thicker than second thickness portion(s) 1522, 1526, and 1528 by various magnitudes. In one example, first thickness 1510 can be twice as thick as second thickness 1520. In another example, first thickness 1510 can be three times as thick as second thickness 1520. Second thickness portion(s) 1522, 1526, and 1528 can form a particular pattern, which can be visible from the inside of the body of golf club head 1400. In particular, first thickness portion(s) 1512, 1514, 1516, and 1518 and second thickness portion(s) 1522, 1526, and 1528 can form one or more cavities, generally shown as cavities 1532, 1534, and 1536. First thickness portion(s) 1512, 1514, 1516, and 1518 can provide structural integrity to golf club head 1400 whereas second thickness portion(s) 1522, 1526, and 1528 can reduce weight from a portion (e.g., the top wall portion) of golf club head 1400. The methods, apparatuses, and articles of manufacture are not limited in this regard.

Figure 16:
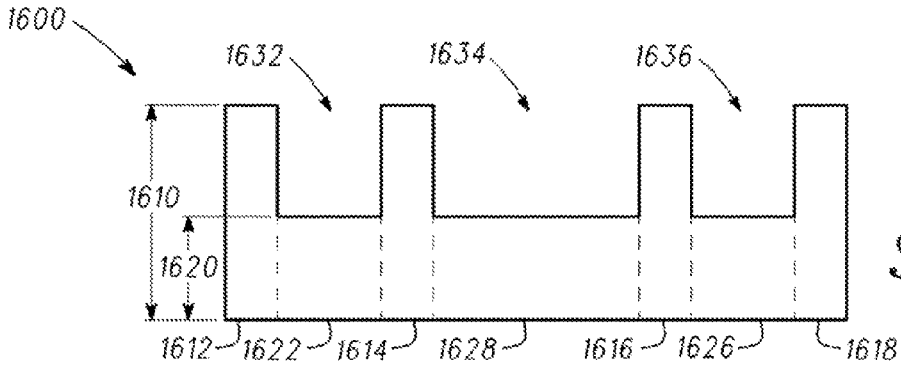
FIG. 16 depicts a cross section view along line 15-15 in FIG. 14 of another exemplary insert of the golf club head of FIG. 14.

Alternatively as depicted in FIG. 16, single-piece insert 1600 with variable thickness can include at least one first thickness portion, generally shown as portions 1612, 1614, 1616, and 1618, and at least one second thickness portion, generally shown as portions 1622, 1626, and 1628. First thickness portion(s) 1612, 1614, 1616, and 1618 can be associated with first thickness 1610 whereas second thickness portion(s) 1622, 1626, and 1628 can be associated with second thickness 1620. First thickness portion(s) 1612, 1614, 1616, and 1618 can be relatively thicker than second thickness portion(s) 1622, 1626, and 1628 by various magnitudes. In one example, first thickness 1610 can be twice as thick as second thickness 1620. In another example, first thickness 1610 can be three times as thick as second thickness 1620. In contrast to second thickness portions 1522, 1526, and 1528 of single-piece insert 1500 in FIGS. 14 and 15, second thickness portion(s) 1622, 1626, and 1628 can form a particular pattern, which can be visible from the outside of golf club head 1400. In particular, first thickness portion(s) 1612, 1614, 1616, and 1618 and second thickness portion(s) 1622, 1626, and 1628 can form one or more cavities, generally shown as cavities 1632, 1634, and 1636. First thickness portion(s) 1612, 1614, 1616, and 1618 can provide structural integrity to golf club head 1400 whereas second thickness portion(s) 1622, 1626, and 1628 can reduce weight from a portion (e.g., the top wall portion) of golf club head 1400. The methods, apparatuses, and articles of manufacture are not limited in this regard.

Although FIG. 14 depicts insert 1500 with a D-shaped configuration, the methods, apparatuses, and articles of manufacture described herein can include single-piece inserts with other suitable configurations. Further, FIG. 14 can be used to enclose an aperture located at or proximate to other portions of golf club head 1400 (e.g., a bottom wall portion, a side wall portion, etc.) and as discussed in further detail below. Although the above examples can describe, and FIGS. 15 and 16 can depict, particular thicknesses of the single-piece inserts, the methods, apparatuses, and articles of manufacture described herein can include single-piece inserts with portions associated with other suitable thicknesses. In addition, while the above examples can describe, and FIGS. 15 and 16 can depict, particular manners in which the thickness portions of the single-piece inserts can vary, the methods, apparatuses, and articles of manufacture described herein can include single-piece inserts with thickness portions varying in a linear manner and/or a non-linear manner (e.g., a transition between the first thickness portion and the second thickness portion can be linear and/or non-linear). The methods, apparatuses, and articles of manufacture are not limited in this regard.

Figure 18:
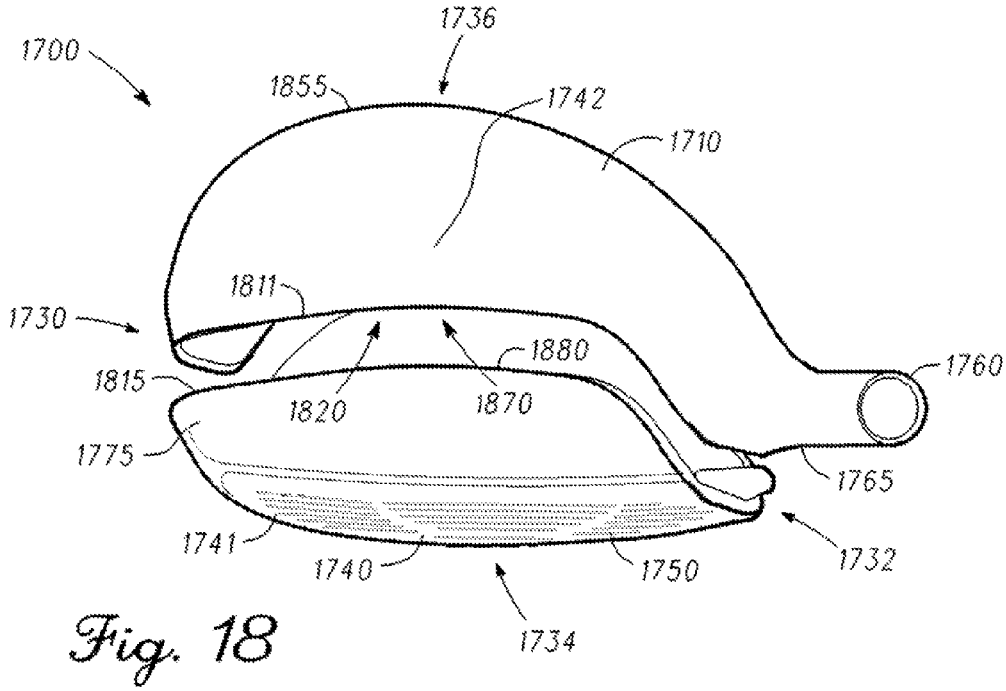
FIG. 18 depicts an exploded top view of the exemplary golf club head of FIG. 17.
Figure 19:
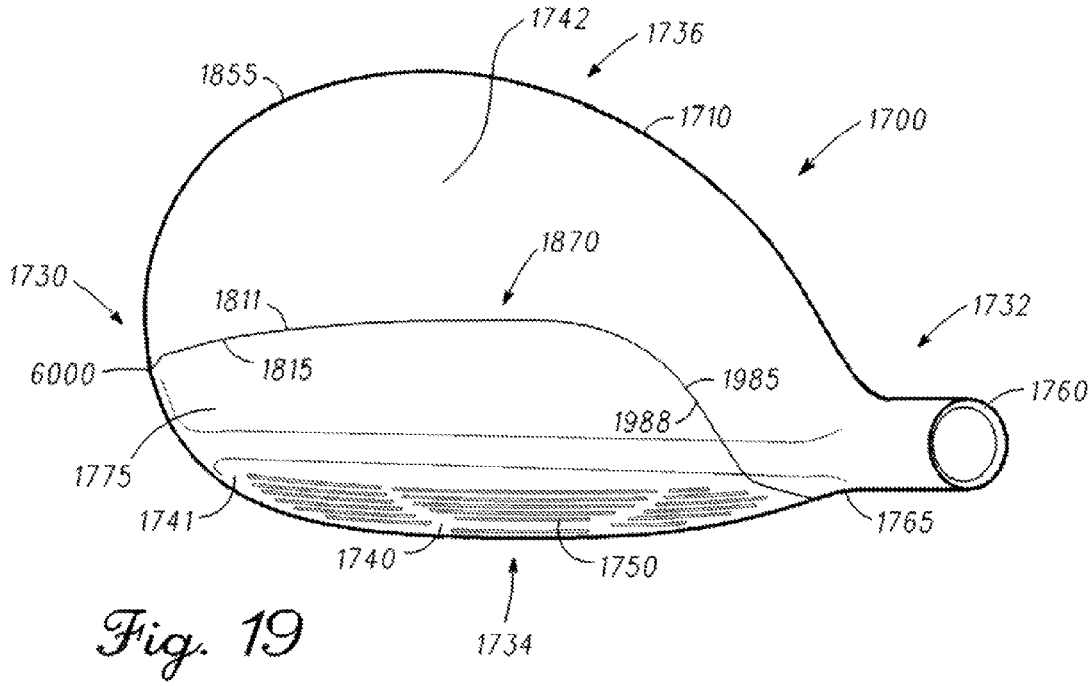
FIG. 19 depicts a top view of the exemplary golf club head of FIG. 17.
Figure 20:
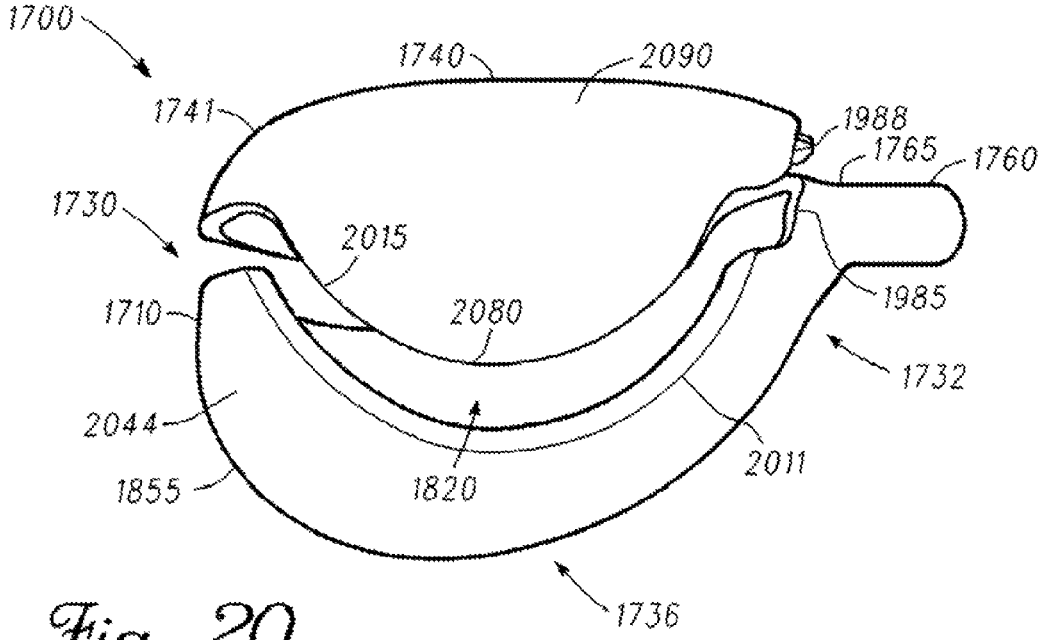
FIG. 20 depicts an exploded bottom view of the exemplary golf club head of FIG. 17.
Figure 21:
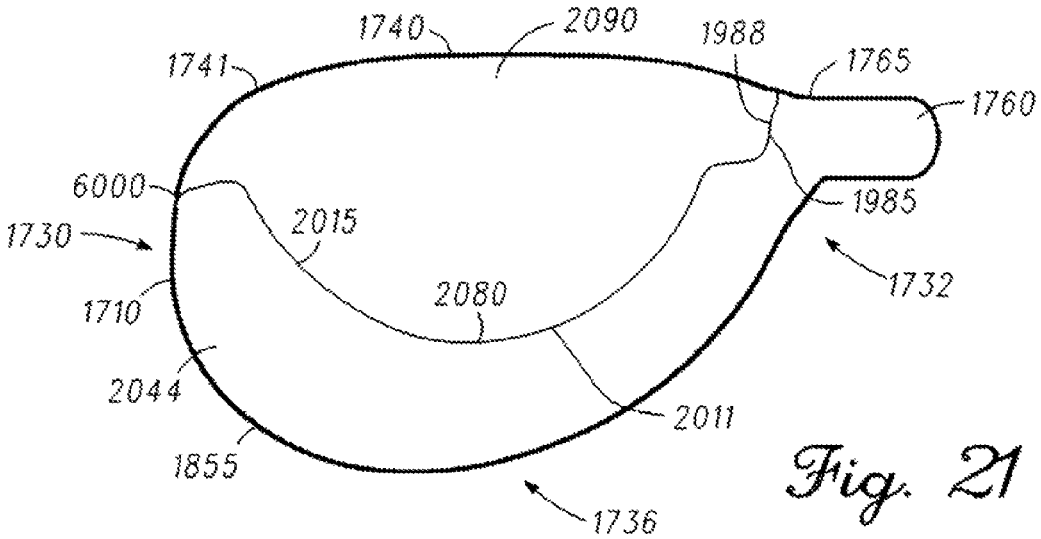
FIG. 21 depicts a bottom view of the exemplary golf club head of FIG. 17.

Turning now to another exemplary golf club head in FIGS. 17-22, golf club head 1700 comprises a cup-like face 1741 that covers opening 1820 (FIG. 18) of hollow body 1710. Cup-like face 1741 includes surface 1740, which comprises grooves 1750. In the same or different example, hollow body 1710 can include one or more arcuate edges located at front end 1870 (e.g., edges 1811 and 2011 of FIGS. 18 and 20, respectively). Accordingly, cup-like face 1741 can also include one or more arcuate edges to couple with the hollow body 1710 at the opening 1720 (e.g., 1815 and 2015 of FIGS. 18 and 20, respectively). As illustrated in FIGS. 17-19 & 22, crown 1742 can include arcuate edge 1811 curved in a concave manner relative to skirt 1855 (FIGS. 18-22) or back end 1736 of hollow body 1710 (e.g., curved in a direction towards skirt 1855 or back end 1736). Arcuate edge 1811 can extend between toe end 1730 and heel end 1732. In the example of FIGS. 20 and 21, sole 2044 can include arcuate edge 2011 curved in a concave manner relative to skirt 1855 or back end 1736 of hollow body 1710 (e.g., curved in a direction towards skirt 1855 or back end 1736). Arcuate edge 2011 can extend between toe end 1730 and heel end 1732. Hollow body 1710 can also include transition edge 1985 (FIG. 19) extending between crown 1742 and sole 2044 at heel end 1732 to join arcuate edges 1811 and 2011. In one example, transition edge 1985 can form a U-shaped configuration.

Figure 17:
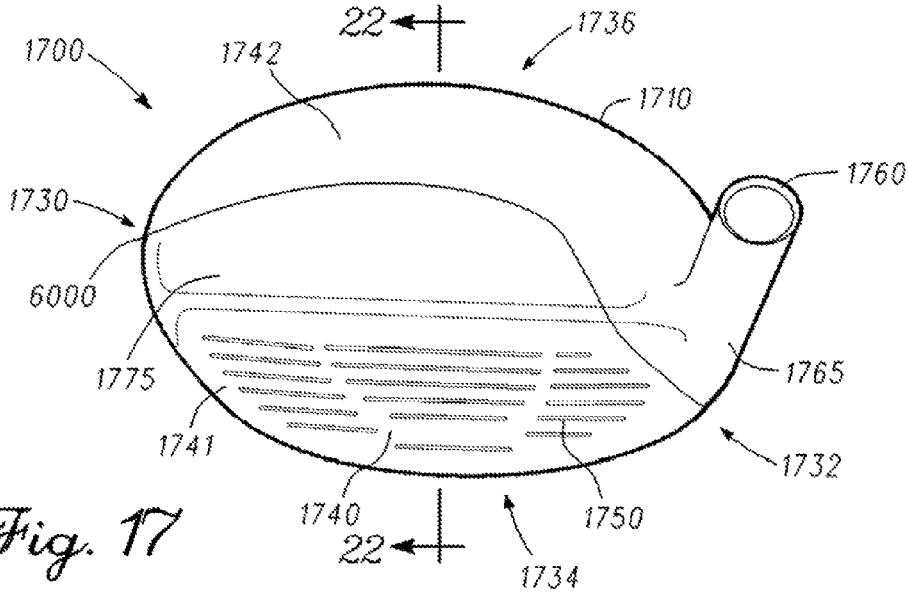
FIG. 17 is a perspective diagram representation of another exemplary golf club head according to an embodiment the methods, apparatuses, and articles of manufacture described herein.

To form golf club head 1700, hollow body 1710 and cup-like face 1741 can be aligned to couple to each other. Referring to FIGS. 17-19, for example, top portion 1775 can include arcuate edge 1815 curved in a convex manner relative to surface 1740 (e.g., curved in a direction towards surface 1740). Arcuate edge 1815 can extend between toe end 1730 and heel end 1732. Turning to FIGS. 20 and 21, for example, bottom portion 2090 can include arcuate edge 2015 curved in a convex manner relative to surface 1740 (e.g., curved in a direction towards surface 1740). The arcuate edge 2015 can extend between toe end 1730 and heel end 1732. Cup-like face 1741 can also include transition edge 1988 extending between top portion 1775 and bottom 2090 at heel end 1732 to join arcuate edges 1815 and 2015. For example, transition edge 1988 can form a U-shaped configuration or other suitable configuration so that cup-like face 1741 can cover opening 1720 (FIG. 17) of hollow body 1710. Accordingly, cup-like face 1741 can cover opening 1720 of hollow body 1710 by aligning arcuate edge 1811 of hollow body 1710 with arcuate edge 1815 of cup-like face 1741, arcuate edge 2011 of the hollow body 1710 with arcuate edge 2015 of cup-like face 1741, and transition edge 1985 of the hollow body 1710 with transition edge 1988 of cup-like face 1741.

As depicted in FIGS. 18-21, arcuate edges 1815 and 2015 can have a bell-shaped configuration, a U-shaped configuration, a parabolic configuration, or any other suitable configurations. Each of arcuate edges 1815 and 2015 can include distal point 1880 and 2080, respectively. Each of the distal points 1880 and 2080 can be a point at arcuate edges 1815 and 2015, respectively, that is the furthest away from surface 1740. For example, distal points 1880 and/or 2080 can be aligned with an impact region of surface 1740. The impact region can be an area at the surface 1740 where an individual can effectively hit a ball. In one example, the impact region can be located at or proximate to the center of the surface 1740. In another example, the impact region can be an area at surface 1740 located closer to toe end 1730 than heel end 1732 or vice versa.

As described in detail below, hollow body 1710 and cup-like face 1741 can be made of two dissimilar metal materials (e.g., two metal materials that can not be feasibly and/or physically welded together). For example, hollow body 1710 can be made of a high-density metal material such as stainless steel, aluminum, tungsten, nickel alloy, and/or any other suitable materials. In contrast, cup-like face 1741 can be made of a relatively light-weight metal material such as titanium, titanium alloy, and/or other suitable materials. With arcuate edges 1811 and 2011 curved in a concave manner relative to skirt 1855 or back end 1736 of hollow body 1710, the size of hollow body 1710 can be reduced (e.g., less high-density metal material used to manufacture the golf club head 1700). With arcuate edges 1815 and 2015 curved in a convex manner relative to surface 1740, the size of cup-like face 1741 can be increased (e.g., more light-weight metal material used to manufacture golf club head 1700). With an increase in a relatively light-weight metal material, the mass at the center of golf club head 1700 can be reduced with arcuate edges 1811, 1815, 2011, and 2015. Thus, hollow body 1710 can generate a higher moment of inertia (MOI), which in turn, can affect feel and/or sound propagated from the golf club head 1700 when the surface 1740 impacts a ball. For example, the material used for cup-like face 1741 (i.e., titanium) can deform and vibrate at its fundamental response frequency, leading to a more pleasing acoustical and vibrational feedback to the individual using the golf club. The joint between hollow body 1710 and cup-like face 1741 can allow cup-like face 1741 to respond naturally to the impact with a golf ball.

If the joint is too close to the leading edge radius of cup-like face 1741, then the joint will interrupt the natural response of the golf club head and will change the overall response frequency of the golf club head.

Further, arcuate edges 1811 and 2011 can provide additional flexibility to insert one or more weight pads within hollow body 1710 because the structure of hollow body 1710 can require less high-density metal material with arcuate edges 1811 and 2011. In addition, cup-like face 1741 can vibrate at the fundamental response frequency of the relatively light-weight metal material when surface 1740 impacts a ball. Thus, golf club head 1700 can provide suitable acoustical and/or vibrational feedback to an individual when the individual hits golf balls with golf club head 1700. The methods, apparatuses, and articles of manufacture described herein are not limited in this regard.

Figure 22:
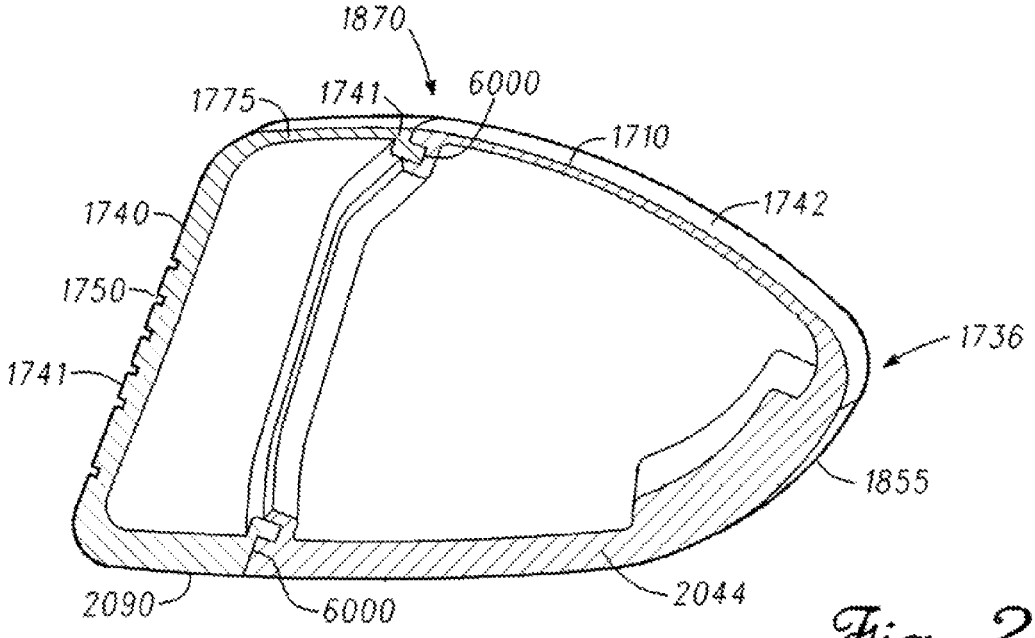
FIG. 22 depicts a cross section along line 22-22 in FIG. 17 of the exemplary golf club head of FIG. 17.

As noted above, brazing processes can be well suited for used to join two dissimilar pieces of metal together. Accordingly, brazing processes can be used to join the hollow body 1710 and cup-like face 1741 together. In one example, the hollow body 1710 can be made of a first metal material such as a tungsten-based metal whereas cup-like face 1741 can be made of a second metal material such as a titanium-based metal. Turning to FIG. 22, for example, hollow body 1710 and cup-like face 1741 can be joined together by brazed joint 6000 comprising a third filler metal such as a copper-based metal or any other suitable materials (e.g., tin, zinc, silver, etc.). With arcuate edges 1811, 1815, 2011, and 2015 (FIGS. 18 and 21), the brazed joint 6000 can be located away from high stress points of golf club head 1700. Brazed joint 6000 can extend along paths formed by arcuate edges 1811, 1815, 2011, and 2015. Further, brazed joint 6000 can also extend along paths formed by transition edges 1985 and 1988 (FIG. 19) between crown 1742, top portion 1775, hosel transition 1765, surface 1740, sole 2044, skirt 1855, and bottom portion 2090.

Brazing processes can also provide a well-finished, clean appearance of hollow body 1710 and cup-like face 1741 at brazed joint 6000 (e.g., additional grinding or finishing can be eliminated in some embodiments). Further, crown 1742, sole 2044, and/or skirt 1855 of hollow body 1710 can be thin-walled structures. Thus, brazing processes can be suitable to join hollow body 1710 to cup-like face 1741 because brazing processes can result in less burn through of crown 1742 and/or sole 2044 than other bonding processes. Further, brazed joint 6000 can withstand severe vibration and shock because brazed joint 6000 can be stronger than the two pieces of metal being bonded together (e.g., hollow body 1710 and cup-like face 1741). By coupling hollow body 1710 and cup-like face 1741 together with a brazing process, the golf club head 1700 can be able to withstand repeated impacts of golf balls at surface 1740 of cup-like face 1741.

Referring again to FIG. 17, surface 1740, top portion 1775, and bottom portion 2090 of cup-like face 1741 can form a U-shaped configuration. Alternatively, cup-like face 1741 can be configured in other suitable shapes such as an L-shaped configuration. In one example, cup-like face 1741 can include surface 1740 and top portion 1775, but not bottom portion 2090 to form an L-shaped configuration. In another example, cup-like face 1741 can include surface 1740 and bottom portion 2090, but not top portion 1775 to form a different L-shaped configuration. The methods, apparatuses, and articles of manufacture described herein are not limited in this regard.

Furthermore, although the above examples can describe hollow body 1710 having arcuate edges 1811 and 2011, one of the edges associated with either crown 1742 or sole 2044 can be a substantially straight edge. Also, FIGS. 29-32 show other embodiments of brazed joint 6000 (FIGS. 19, 21, and 22). Portions 2901 and 2902 in FIG. 29 can represent portions of hollow body 1710 and cup-like face 1741, respectively, in FIG. 22, and joint 2910 in FIG. 29 can represent brazed joint 6000 in FIG. 22. In a different embodiment, portions 2901 and 2902 in FIG. 29 can represent portions of cup-like face 1741 and hollow body 1710, respectively, in FIG. 22, and joint 2910 in FIG. 29 can represent brazed joint 6000 in FIG. 22. Similarly, portions 3001 and 3001 in FIG. 30 can represent portions of hollow body 1710 and cup-like face 1741, respectively, in FIG. 22, and joint 3000 in FIG. 30 can represent brazed joint 6000 in FIG. 22, and edges 3010 and 3020 in FIG. 30 can represent edges 1811 and 1815, respectively, in FIG. 18. Turning to the next figure, portions 3101 and 3101 in FIG. 31 can represent portions of hollow body 1710 and cup-like face 1741, respectively, in FIG. 22 (or vice versa), and joint 3100 in FIG. 31 can represent brazed joint 6000 in FIG. 22, and edges 3110 and 3120 in FIG. 31 can represent edges 1811 and 1815, respectively, in FIG. 18 (or vice versa). Moreover, portions 3201 and 3201 in FIG. 32 can represent portions of hollow body 1710 and cup-like face 1741, respectively, in FIG. 22 (or vice versa), and joint 3200 in FIG. 32 can represent brazed joint 6000 in FIG. 22, and edges 3210 and 3220 in FIG. 32 can represent edges 1811 and 1815, respectively, in FIG. 18 (or vice versa). Additional details regarding FIGS. 29-32 are described below.

While the above examples describe various portions and/or surfaces of golf club head 1700 in FIG. 17, golf club head 1700 can not include certain portions and/or surfaces. For example, although FIGS. 17-22 depict crown 1742, sole 2044, and skirt 1855 as separate surfaces, skirt 1855 can merge with either crown 1742 or sole 2044 to form a single surface of hollow body 1710 (e.g., the hollow body 1710 can include crown 1742 and sole 2044 but not skirt 1855). In one example, sole 2044 and skirt 1855 can merge into a single bottom surface of golf club head 1700. In a similar manner, although surface 1740, top portion 1775, and bottom portion 2090 can be depicted as separate surfaces, surface 1740 can merge with either top portion 1775 or bottom portion 2090 to form a single surface of cup-like face 1741. Further, while FIGS. 17-22 can depict hosel 1760 and hosel transition 1765, golf club head 1700 may not include hosel 1760 and/or hosel transition 1765. In one example, the golf club head can include a bore (not shown) within hollow body 1710 to receive a shaft (e.g., an opening of the bore can be flushed with the crown 1742). The methods, apparatuses, and articles of manufacture described herein are not limited this regard.

Figure 23:
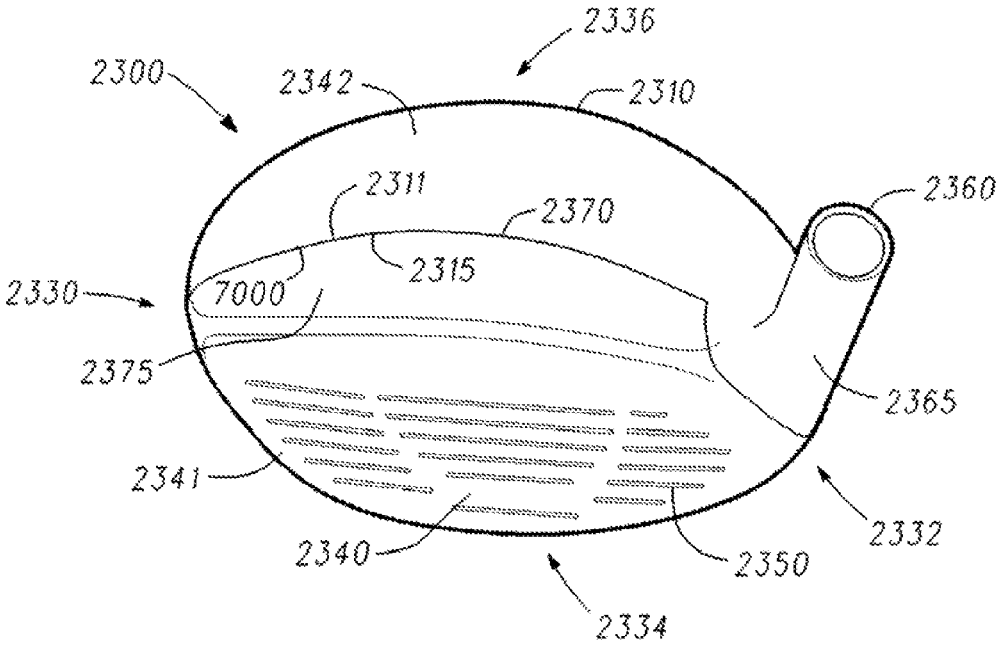
FIG. 23 is a perspective diagram representation of an exemplary golf club head according to another embodiment of the methods, apparatuses, and articles of manufacture described herein.
Figure 24:
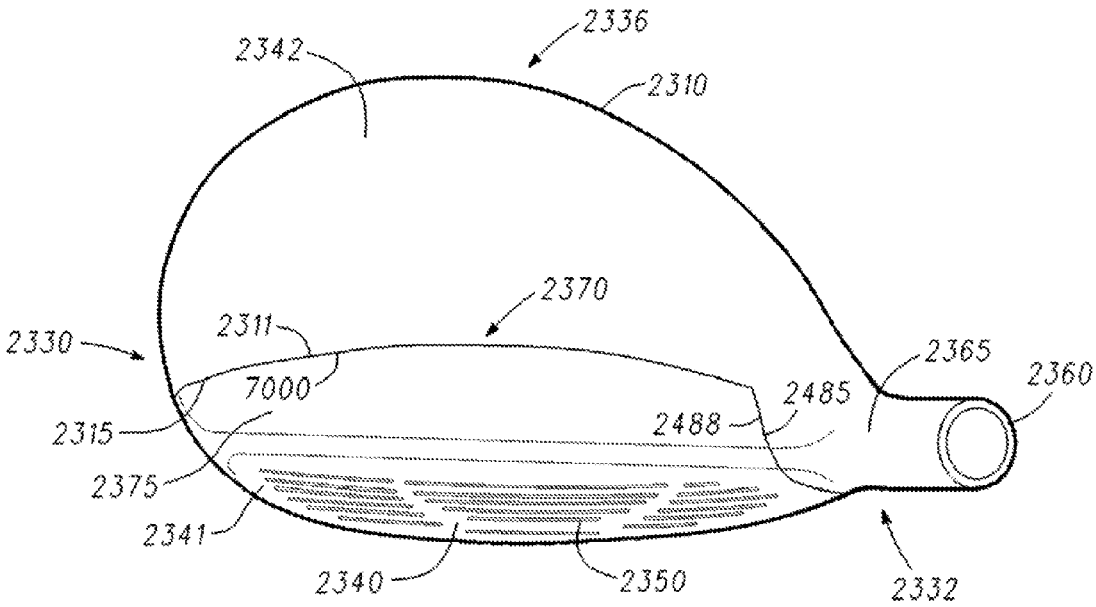
FIG. 24 depicts a top view of the exemplary golf club head of FIG. 23.
Figure 25:
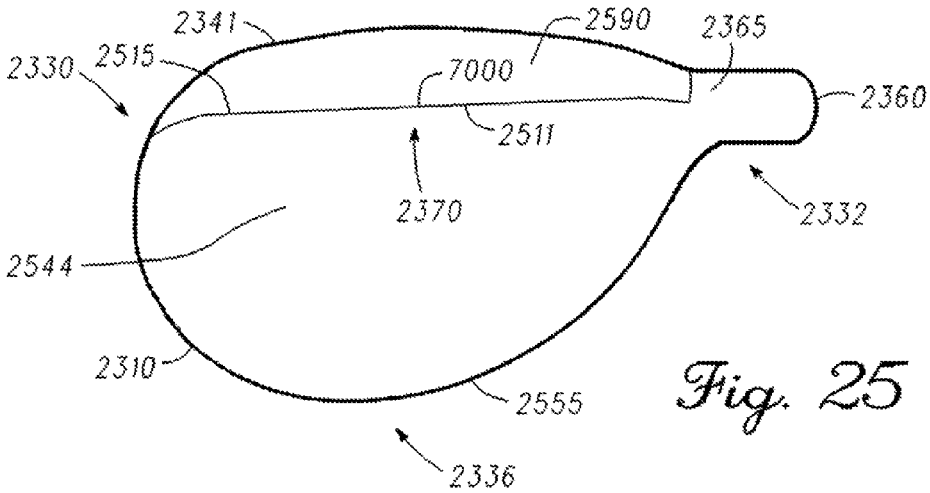
FIG. 25 depicts a bottom view of the exemplary golf club head of FIG. 23.

In the example of FIGS. 23-25, golf club head 2300 can include hollow body 2310 and cup-like face 2341. Hollow body 2310 can include toe end 2330, heel end 2332, crown 2342 (e.g., a top wall), sole 2544 (e.g., a bottom wall), and skirt 2555 (e.g., a side wall). Skirt 2555 can be located between crown 2342 and sole 2544 (FIG. 25) and wrap around back end 2336 of golf club head 2300 from toe end 2330 to heel end 2332. Hollow body 2310 can also include hosel 2360 and hosel transition 2365. For example, hosel 2360 can be located at or proximate to heel end 2332. Hosel 2360 can extend from crown 2342 via hosel transition 2365.

Cup-like face 2341 can be located a front end 2334 of golf club head 2300 and can include surface 2340, top portion 2375, and bottom portion 2590 (FIG. 25). The surface 2340 can be configured to impact a golf ball. In particular, the surface 2340 can include plurality of grooves 2350. Plurality of grooves 2350 can be elongated in a direction between toe end 2330 and heel end 2332 at surface 2340. Top and bottom portions 2475 and 2590 can be configured to couple cup-like face 2341 with hollow body 2310 at an opening, similar to opening 1820 in FIG. 18.

In contrast to golf club head 1700 (FIGS. 17-22), golf club head 2300 can include arcuate edge 2311 and straight edge 2511 (FIG. 25). In particular, the hollow body 2310 can include arcuate edge 2311 at front end 2370 of crown 2342, and straight edge 2511 at front end 2370 of sole 2544. Arcuate edge 2311 and straight edge 2511 can extend between toe end 2330 and heel end 2332. Arcuate edge 2311 can curve in a concave manner relative to skirt 2555 or back end 2336 of hollow body 2310. Hollow body 2310 can also include transition edge 2485 (FIG. 24) extending between crown 2342 and sole 2544 at heel end 2311 to join arcuate edge 2311 and straight edge 2511. Accordingly, cup-like face 2341 can also include arcuate edge 2315 at top portion 2375 and straight edge 2515 at bottom portion 2590. Arcuate edge 2315 can curve in a convex manner relative to surface 2340 of cup-like face 2341. Cup-like face 2341 can also include transition edge 2488 (FIG. 24) extending between top and bottom portions 2475 and 2590 to join arcuate edge 2315 and straight edge 2515.

To form golf club head 2300, cup-like face 2341 can cover an opening (not shown) at front end 2370 of hollow body 2310 by aligning arcuate edge 2311 of hollow body 2310 with arcuate edge 2315 of cup-like face 2341 and straight edge 2511 of hollow body 2310 with straight edge 2515 of cup-like face 2341. Brazed joint 7000 can couple hollow body 2310 and cup-like face 2341 together at arcuate edges 2311 and 2315 and straight edges 2511 and 2515. Brazed joint 7000 can extend in an arcuate path formed by arcuate edges 2311 and 2315, but a substantially straight path formed by straight edges 2511 and 2515.

In a different embodiment (not shown), crown 2342 can include a straight edge at front end 2370 whereas sole 2544 can include an arcuate edge at front end 2370. To couple hollow body 2310 and cup-like face 2341 together, top portion 2375 can include a straight edge whereas bottom portion 2590 can include an arcuate edge. As a result, in this different embodiment, brazed joint 7000 can extend in an arcuate path formed by arcuate edges of the crown 2342 and top portion 2375 and a substantially straight path formed by the straight edges of sole 2544 and bottom portion 2590. The methods, apparatuses, and articles of manufacture described herein are not limited in this regard.

Figure 26:
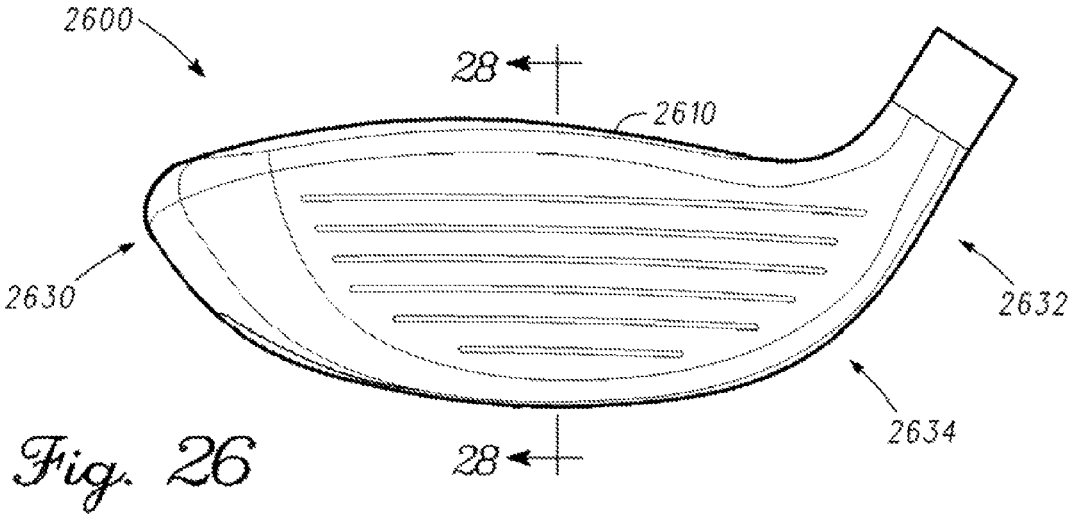
FIG. 26 depicts a front view of another exemplary golf club head according to an embodiment of the methods, apparatuses, and articles of manufacture described herein.
Figure 27:
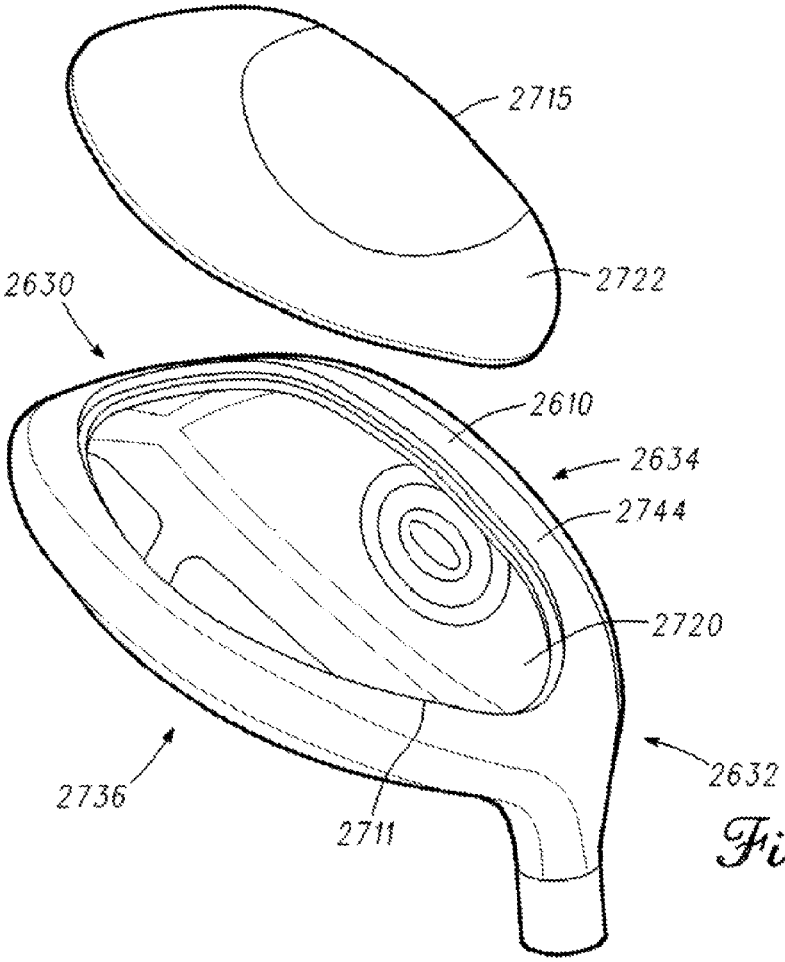
FIG. 27 depicts an exploded bottom perspective view of the exemplary golf club head of FIG. 26.
Figure 28:
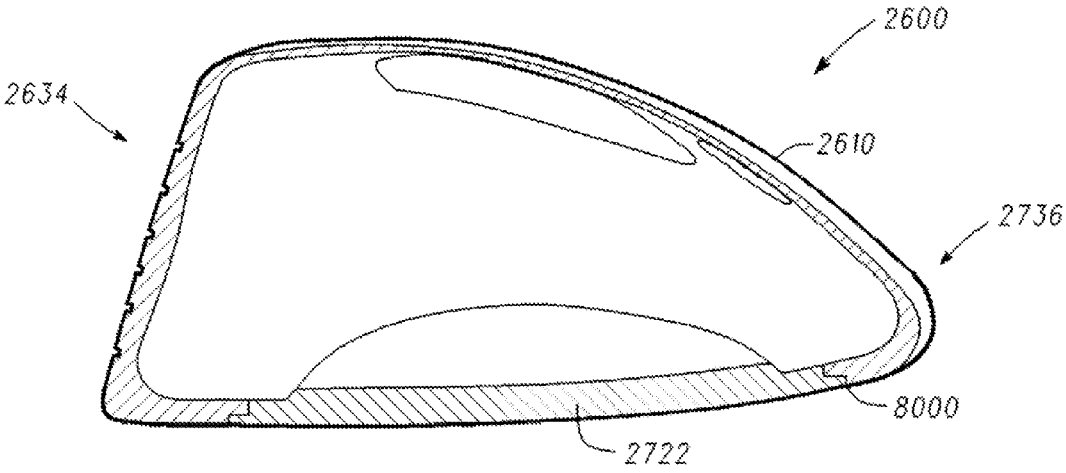
FIG. 28 depicts a cross section view along line 28-28 in FIG. 26 of the exemplary golf club head of FIG. 26.
Figure 29:
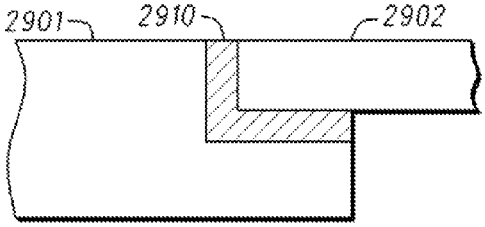
FIGS. 29-32 depict exemplary joints of exemplary golf club heads according to embodiments of the methods, apparatuses, and articles of manufacture described herein.

Turning now to FIGS. 26-28, another exemplary golf club comprises golf club head 2600 having hollow body 2610 and bottom insert 2722 to cover opening 2720 at hollow body 2610. Opening 2720 and insert 2722 can be similar to opening 429 (FIG. 4) and insert 1229 (FIG. 12), respectively, of exemplary golf club head 100 described earlier. In one example, hollow body 2610 can include one or more arcuate edges 2711 located about sole 2744. Accordingly, insert 2722 can also include one or more arcuate edges 2715 to couple with hollow body 2610 at opening 2720. Arcuate edges 2711 can extend about sole 2744, between toe end 2630 and heel end 2632, and front end 2634 and back end 2736. In the example of FIGS. 26-28 arcuate edges 2711 can be curved in a concave manner, but among other embodiments (not shown), edges 2711 may be straight, or a combination of arcuate and straight edges, which can receive or couple to complimentarily-shaped insert 2722. FIG. 28 depicts a cross section of hollow body 2610 showing insert 2722 brazed at lap joint 8000. While the brazed joint shown is a lap joint, other types of brazed joints, as were discussed in greater detail above, can be used. The methods, apparatuses, and articles of manufacture described herein are not limited in this regard.

While various openings and respective inserts are discussed throughout this disclosure, the golf club heads described can comprise any combination of such openings and inserts. For example, a golf club head can include some or all of openings 122, 124, 126, and 128 (FIG. 3) at the top of body 110, the opening of the golf club head body in which insert 1500 (FIG. 14) is located, front opening 1820 (FIG. 18) of body 1710, bottom opening 429 (FIG. 4) of body 110, and opening 2720 (FIG. 27) of body 2610. An exemplary golf club head can also include some of these openings and inserts, without others of these openings and inserts. For example, a golf club head may include some or all of openings 122, 124, 126, and 128 (FIG. 3) at the top of body 110 and front opening 1820 (FIG. 18) of body 1710, but without bottom opening 429 (FIG. 4) of body 110, opening 2720 (FIG. 27) of body 2610, or the opening of the golf club head body in which insert 1500 (FIG. 14) is located. As another example, golf club head may include the front opening 1820 (FIG. 18) of body 1710, and bottom opening 429 (FIG. 4) of body 110 or opening 2720 (FIG. 27) of body 2610, but without some or all of openings 122, 124, 126, and 128 (FIG. 3) at the top of body 110, or the opening of the golf club head body in which insert 1500 (FIG. 14) is located. In a further example, a golf club head may also include some or all of openings 122, 124, 126, and 128 (FIG. 3) at the top of body 110 with bottom opening 429 (FIG. 4) of body 110 or opening 2720 (FIG. 27) of body 2610, but without front opening 1820 (FIG. 18) of body 1710, or the opening of the golf club head body in which insert 1500 (FIG. 14) is located. Other combinations and permutations are also contemplated herein. In this manner, with the various inserts coupled to the described openings, the CG and MOI of a golf club head can be customized or specifically tailored for an individual.

Figure 34:
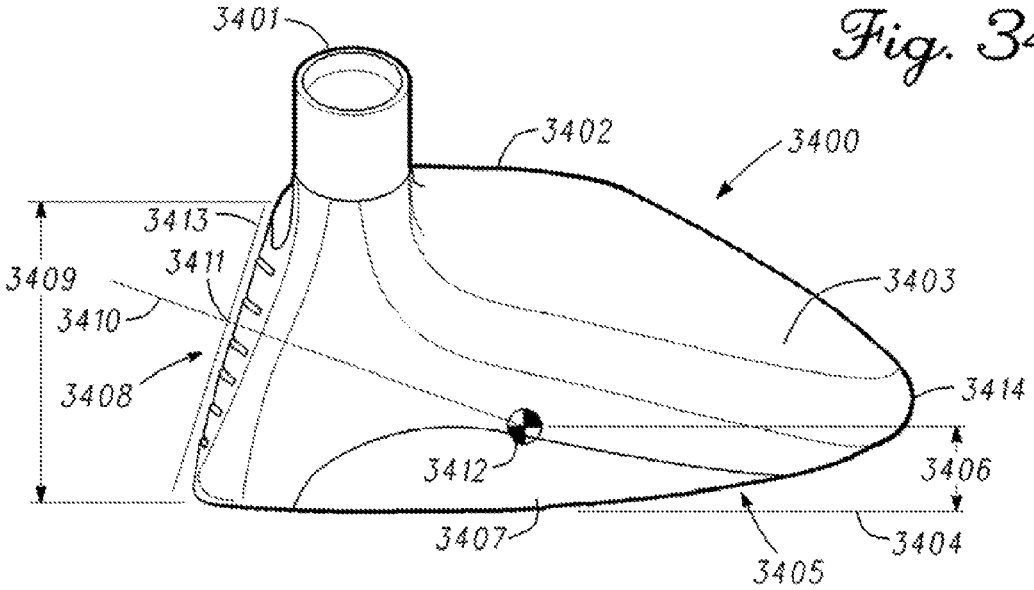
FIG. 34 depicts an exemplary side view of an exemplary golf club head according to an embodiment of the methods, apparatuses, and articles of manufacture described herein.

Turning to FIG. 34, additional details regarding the CG and MOI of golf club head 3400 are provided. These details can also describe one or more of the golf club heads described previously in FIGS. 1-32. Golf club head 3400 of FIG. 34 includes an insert 3407, which in the illustrated embodiment is a weight that has a higher density than the rest of golf club head 3400 (i.e., portion 3403). In the present example, insert 3407 is substantially D-shaped, similar to insert 2722 (FIGS. 27-28), but there can be other embodiments where insert 3407 comprises other shapes, such a shape similar to that of insert 1229 (FIG. 2, 12). Although not illustrated in FIG. 34, golf club head 3400 can also have one or more other inserts, as described previously with reference to FIGS. 1-32. If present in this embodiment, however, these one or more other inserts can have a lower density than insert 3407. These inserts also can have a lower density than other portions of golf club head 3400 such as portion 3403.

In addition to insert 3407, golf club head 3400 also includes club head high point 3401, which can be represented by the top-most point of the hosel of the club head. In the embodiment illustrated in FIG. 34, club head high point 3401 is the top of the hosel. Golf club head 3400 can further include crown high point 3402, which can be lower than club head high point 3401 when golf club head 3400 includes a hosel. Golf club head 3400 also includes club head low point 3404 from which club head high point 3401 and crown high point 3402 are measured in a substantially perpendicular direction. Golf club head 3400 can also include skirt 3414, or in a different embodiment, golf club head can be skirtless. Golf club head 3400 additionally includes CG 3412 having CG height 3406, as measured in a substantially perpendicular direction from club head low point 3404. Golf club head 3400 additionally has front face 3408 with face height 3409, as also measured in a substantially perpendicular direction from club head low point 3404. Line 3410 is drawn from CG 3412 towards front face 3408 of the club head and is substantially perpendicular to front face 3408. In one embodiment, front face 3408 is curved so, to facilitate the explanation of line 3410, line 3413 is drawn in FIG. 34 to represent a flat front face. Line 3410 can also represent the loft of front face 3408. In this embodiment, line 3413 drawn to be substantially perpendicular to line 3410, and lines 3413 and 3410 intersect at intersection point 3411. In the same or different embodiment, intersection point 3411 can be at the intersection of line 3413 and front face 3408.

In the illustrated embodiment of FIG. 34, insert 3407 has a high density relative to portion 3403 and represents more than half of the mass of golf club head 3400. In other words, insert 3407 has an insert mass, and golf club head 3400 has a club head mass, which includes the insert mass and where the insert mass is greater than fifty percent of the club head mass. Also in the illustrated embodiment of FIG. 34, insert 3407 represents less than half of the volume of the club head materials used to construct golf club head 3400. In the same or other embodiments, insert 3407 can represent at least 40% of the mass of golf club head 3400, while still representing less than half of the volume of the club head materials. In the same or other examples, insert 3407 may represent at least approximately 45% of the volume of club head materials. Several ranges of mass and/or volume for insert 3407 may be suitable for in the same or other examples, such that insert 3407 may comprise a range of between approximately 41% to approximately 45% of the club head mass, and/or where insert 3407 may comprise a range of between approximately 42% to approximately 46% of the volume of the club head materials. In one particular embodiment, insert 3407 may comprise approximately 43% of the club head mass, and approximately 44% of the volume of the club head materials.

The mass and volume characteristics described above can help to lower the center of gravity of the golf club head and permit the adjustment of the center of gravity relative to the front face of the golf club head. In the past, attempts have been made to lower the center of gravity by lowering the total height of the golf club head, but these types of modified golf club heads can have other problems. Therefore, in one embodiment, club head high point 3401, crown high point 3402, and face height 3409 can have standard club head measurements, and the volume of golf club head 3400 can remain similar to standard club head volumes, while club head 3400 still has the improved center of gravity and moment of inertia.

In the same or different embodiment, insert 3407 is located at or below one or more of the following: the crown portion of the club head, skirt 3414, half of face height 3409, forty percent of club head high point 3401, thirty percent of club head high point 3401, or 0.6 inches from club head lower point 3404. In an embodiment where the golf club head has the sole insert, but does not have any inserts in the crown, then all of the brazed joints in the golf club head also can be located at or below one or more of the same features identified above. In the same or different embodiment, the insert mass is more than half of the club head mass, and insert 3407 represents less than thirty-eight percent of the volume of the materials used to construct golf club head 3400. As an example, if portion 3403 comprises stainless steel and if insert 3407 comprises tungsten, insert 3407 can account for over fifty percent of the mass of golf club head 3400 while representing less than thirty-one percent of the volume of the materials used to construct golf club head 3400. In the same or different embodiment, CG height 3406 is located at or below one or more of the following: thirty-two percent of face height 3409, thirty percent of crown high point 3402, or twenty-three percent of club high point 3401. Also, intersection point 3411 can be located at or below one or more of the following: fifty-nine percent of the height of front face 3408 as measured from the loft plane of front face 3408 (i.e., as measured along line 3413), or fifty-eight percent of face height 3409. Again, these details of golf club head 3400 help to lower the CG and customize the MOI of the club head.

Figure 30:
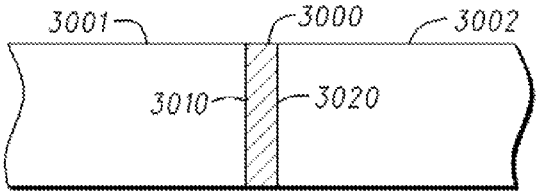
Figure 31:
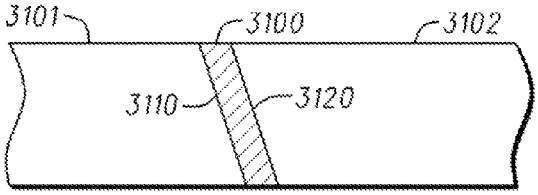
Figure 32:
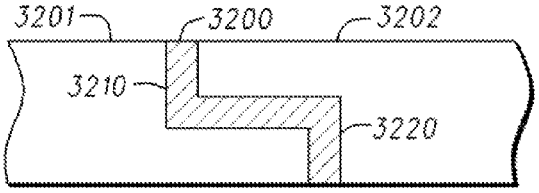

The methods, apparatuses, and articles of manufacture described herein for the various exemplary golf club heads can use any suitable type of joints for brazing. In certain examples, brazed joints can be lap joints, butt joints, and/or straight, slanted, C-shaped, S-shaped, type joints. Referring to back to FIG. 30, for example, brazed joint 3000 can be a butt joint where brazed joint 3000 can be positioned in a flushed, end-to-end arrangement. In one example, each of portions 3001 and 3002 of the joined material can have a substantially, vertical straight edge, generally shown as edges 3010 and 3020, respectively. Accordingly, brazed joint 3000 can join the substantially, vertical, straight edges 3010 and 3020 together. In a different embodiment, as illustrated in FIG. 31, each of portions 3101 and 3102 can have a slanted, straight edge, generally shown as edges 3110 and 3120, respectively. Accordingly, brazed joint 3100 can join the slanted, straight edges 3110 and 3120 together. Turning to FIG. 32, for yet another example, brazed joint 3200 can be a butt-lap joint. The brazed joint 3200 can have an S-shaped configuration. In one example, each of portions 3101 and 3102 can have an edge with an L-shaped configuration, generally shown as edges 3210 and 3220, respectively. Accordingly, brazed joint 3200 can join L-shaped edges 3210 and 3220 together. The methods, apparatuses, and articles of manufacture are not limited in this regard.

Figure 33:
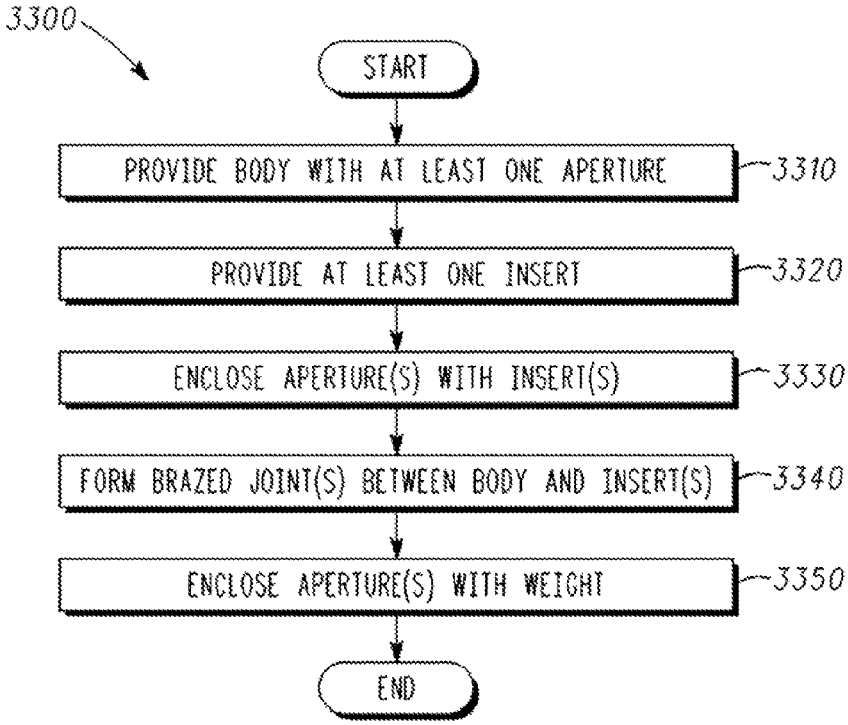
FIG. 33 is a flow diagram representation of one embodiment in which the exemplary golf club heads can be manufactured.

In the example of FIG. 33, process 3300 for providing the various exemplary golf club heads discussed herein can begin with providing the body to form the golf club head (a block 3310). In one example, the body can be formed by a casting or forging process. As noted above, the body can be made of a high-density metal material (e.g., stainless steel). The body can include one or more openings or apertures. Portions of the body can removed to form the openings or apertures, or the body can be cast or forged with the openings or apertures. Process 3300 can also provide one or more inserts for the openings or apertures (a block 3320). The inserts can be made of a relatively lighter mass metal material (e.g., titanium), or a heavier mass metal material. The inserts can be used to enclose the apertures of the body (a block 3330). As noted above, the body and the inserts can be made of dissimilar metal materials. Also, block 3330 can include covering, filling, locating, or otherwise positioning the inserts in the apertures. As use herein, the phrase "positioning . . . in" can include positioning . . . over. Then, the body and the inserts can be coupled together by a brazing or other adhering or securing process (a block 3340). In particular, the brazing process can form brazed joints with a filler metal material (e.g., copper) between the body and the inserts, where the filler metal material is different from the metal material used for the body and the inserts. In a different embodiment block 3340 can be part of block 3330. Process 3300 can also enclose the apertures of the body with a weight (a block 3350). For example, the weight can be made of tungsten or other suitable materials. Block 3350 can include a brazing process to couple together the body and the weight. The methods, apparatuses, and articles of manufacture are not limited in this regard.

Although process 3300 can be described above with respect to golf club heads 100 (FIG. 1), 1400 (FIG. 14), 1700 (FIG. 17), 2300 (FIGS. 23), and 2600 (FIG. 26), process 3300 can be applicable to other golf club heads. In addition, while a particular order of actions is illustrated in FIG. 33, these actions can be performed in other temporal sequences. For example, two or more actions depicted in FIG. 33 can be performed sequentially, concurrently, or simultaneously. Additionally, although FIG. 33 depicts a particular number of blocks, process 3300 can skip one or more blocks. In one example, process 3300 may not include the block 3350 because the opening or aperture may be enclosed with an insert that is not a weight.

In process 3300, the openings or apertures can be similar to, for example, one or more of openings 122, 124, 126, and 128 (FIG. 1) at the top of body 110, the opening of the golf club head body in which insert 1500 (FIG. 14) is located, front opening 1820 (FIG. 18) of body 1710, bottom opening 429 (FIG. 4) of body 110, and opening 2720 (FIG. 27) of body 2610. Similarly, he inserts in process 3300 can be similar to one or more of inserts 1100 (FIG. 1) at the top of body 110, inserts 1500 (FIG. 15) or 1600 (FIG. 16) at the top of the golf club head body 1400, front cup-like faces 1741 or 2341, bottom insert 1229 (FIG. 12) of body 110, or insert 2722 (FIG. 27) of body 2610. Moreover, brazed joints can be similar to brazed joints 1310, 1320, 1330, 1340, etc. (FIG. 13), of body 110, the brazed joint of golf club head 1400 (FIG. 14), brazed joints 6000 (FIG. 17) of body 1710, brazed joints 7000 (FIG. 23) of body 2310, brazed joints 8000 (FIG. 28) of body 2610, or brazed joints 2910, 3000, 3100, and 3200 (FIGS. 29-32).

Although the above examples describe the use of brazing processes to couple the various hollow bodies and respective inserts together, the methods, apparatuses, and articles of manufacture described herein can use other suitable bonding and/or fusing techniques and processes. Accordingly, the article, system, and method discussed herein can be implemented in a variety of embodiments, and that the foregoing discussion of certain of these embodiments does not necessarily represent a complete description of all possible embodiments. Rather, the detailed description of the drawings, and the drawings themselves, disclose at least one preferred embodiment of a golf club head and method of manufacture, and can disclose alternative embodiments of a golf club head and method of manufacture. As an example of another variation, the embodiment described in FIGS. 14 and 15 can be combined with the embodiment described in FIG. 34. As a further example, other embodiments or portions thereof can be combined with other embodiments or portions thereof.

All elements claimed in any particular claim are essential to a golf club head and method of manufacture claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that can cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

The invention claimed is:

1. A golf club head comprising:
a front end comprising a front face;
a rear end;
a bottom portion; and
a top portion;
wherein:
the golf club head comprises a club head mass;
the bottom portion comprises:
a first bottom section coupled to the front end; and
a second bottom section between the first bottom section and the rear end; the second bottom section comprises at least approximately 40% of the club head mass; and
the second bottom section comprises less than half of a volume of materials of the golf club head;
the first bottom section comprises a first material;
the second bottom section comprises a second material different than the first material;
the second bottom section comprises an insert comprising the second material;
a mass of the insert comprises at least approximately 40% of the club head mass;
the insert comprises less than half of a volume of materials of the golf club head; and
the materials of the golf club head comprise the first material and the second material.

2. The golf club head of claim 1, wherein:
the second bottom section comprises more than half of the club head mass.

3. The golf club head of claim 1, wherein:
the second bottom section comprises less than approximately 45% of the volume of materials of the golf club head.

4. The golf club head of claim 1, further comprising:
a skirt portion between the top and bottom portions;
wherein:
the front end comprises a transition region between the front face and the first bottom section; and
the second bottom section is separated from the transition region by the first bottom section.

5. The golf club head of claim 1, wherein:
the insert is substantially "D" shaped;
the bottom portion comprises a first aperture; and
the insert is located in the first aperture and exposed to at least one of:
an interior of the golf club head; or
an exterior of the golf club head.

6. The golf club head of claim 1, wherein:
the second bottom section bounds a perimeter of the insert; and
the insert comprises less than thirty-eight percent of the volume of the materials of the golf club head.

7. The golf club head of claim 1, wherein:
the insert is located fully below at least one of:
forty percent of a highest point of the golf club head; or
0.6 inch above the bottom portion.

8. The golf club head of claim 1, further comprising:
a brazed joint comprising a third material and coupling the insert to the bottom portion;
wherein:
the first material comprises at least one of stainless steel, aluminum, tungsten, magnesium, or nickel alloy;
the second material is denser than the first material; and
the third metal material comprises at least one of a copper material, a tin material, a silver material, or a zinc material.

9. The golf club head of claim 1, further comprising:
a toe end and a heel end;
wherein the insert comprises:
a center portion located towards the rear end and substantially centered between the toe and heel ends;
a heel arm extending from the center portion substantially towards the heel end and the first bottom section;
a toe arm extending from the center portion substantially towards the toe end and the first bottom section; and
a front edge between the heel and toe arms and substantially concave relative to the front end.

10. A golf club head comprising:
a front end comprising a front face;
a rear end;
a bottom portion;
a top portion;
one or more top apertures located at the top portion; and
one or more top inserts located in the one or more top apertures;
wherein:
the golf club head comprises a club head mass;
the bottom portion comprises:
a first bottom section coupled to the front end; and
a second bottom section between the first bottom section and the rear end;
the second bottom section comprises at least approximately 40% of the club head mass; and
the second bottom section comprises less than half of a volume of materials of the golf club head;
the first bottom section comprises a first material;
the second bottom section comprises a second material different than the first material;
the one or more top inserts comprise a third material; and
the third material of the one or more top inserts is less dense than the first material.

11. The golf club head of claim 10, wherein:
the one or more top inserts comprise a single-piece top insert;
the single-piece top insert comprises:
one or more first segments comprising a first thickness; and
one or more second segments comprising a second thickness and coupled to the one or more first segments;
and
the second thickness is greater than the first thickness.

12. The golf club head of claim 11, wherein:
the top portion comprises one or more grid segments arranged in a first grid pattern that defines the one or more top apertures;
the one or more first segments of the single-piece top insert are arranged in a second grid pattern matching the first grid pattern; and
the one or more first segments of the single-piece top insert abut the one or more grid segments of the top portion when the one or more top inserts are located in the one or more top apertures.

13. A golf club head comprising:
a front end comprising a front face;
a rear end;
a bottom portion comprising a club head low point of the golf club head;
a top portion;
a hosel protruding from the top portion; and
a center of gravity at a center of gravity height;
wherein:
the golf club head comprises a club head mass;
the bottom portion comprises:
a first bottom section coupled to the front end; and
a second bottom section between the first bottom section and the rear end;
the second bottom section comprises at least approximately 40% of the club head mass;
the second bottom section comprises less than half of a volume of materials of the golf club head; and
when the golf club head is at address with the club head low point over a horizontal plane, the center of gravity height is located, measured perpendicular to the horizontal plane, below at least one of the following:
thirty-two percent of a height of the front face;
thirty percent of a highest point of the top portion; or
twenty-three percent of a highest point of the hosel.

14. The golf club head of claim 13, wherein:
the center of gravity height is located below thirty-two percent of the height of the front face.

15. The golf club head of claim 13, wherein:
the center of gravity height is located below thirty percent of the highest point of the top portion.

16. The golf club head of claim 13, wherein:
the center of gravity height is located below twenty-three percent of the highest point of the hosel.

17. A golf club head comprising:
a hollow body comprising a sole, a crown, and a strike face;
a first weight coupled to the sole; and
a joint coupling together the sole and the first weight;
wherein:
the sole comprises:
a rear sole section bounding the first weight; and
a front sole section coupled to the strike face and separating the rear sole section from the strike face;
the first weight is separated from the strike face by the front sole section;
at least the sole of the hollow body comprises a first metal;
the first weight comprises a second metal different than the first metal;
the joint comprises a joint material different than the first and second metals;
the golf club head comprises a club head mass;
the first weight comprises a weight mass;
the club head mass comprises the weight mass;
the weight mass comprises more than at least approximately 40% of the club head mass;
a mass volume of the first weight comprises less than 50% percent of a mass volume of materials of the golf club head; and
the materials of the golf club head comprise the first metal, the second metal, and the joint material.

18. The golf club head of claim 17, wherein:
the weight mass comprises between approximately 41% to approximately 45% of the club head mass;
the mass volume of the first weight comprises between approximately 42% to approximately 46% of the mass volume of the materials of the golf club head;
the rear sole section comprises a first opening through which the first weight is inserted; and
the first weight is exposed to an internal side of the sole and to an external side of the sole.

19. The golf club head of claim 18, further comprising:
a crown insert;
wherein:
the crown comprises a crown opening;
the crown insert is located in the crown opening;

the first weight comprises a first density;

the crown insert comprises a second density; and the hollow body comprises a body density less than the first density and greater than the second density.

20. A method for providing a golf club head, the method comprising:

providing a front end of the golf club head, the front end comprising a front face;

providing a rear end of the golf club head;

providing a bottom portion of the golf club head; and providing a top portion of the golf club head;

wherein:

providing the bottom portion comprises:

providing a first bottom section coupled to the front end; and providing a second bottom section between the first bottom section and the rear end;

providing the second bottom section comprises:

providing the second bottom section to comprise at least approximately 40% of a club head mass of the club head; and providing the second bottom section to comprise less than half of a volume of materials of the golf club head;

providing the front end comprises:

providing a transition region between the front face and the first bottom section, the second bottom section being separated from the transition region by the first bottom section;

providing the second bottom section comprises:

providing an insert into an aperture of the second bottom section; and providing the insert comprises:

providing a material of the insert to be more dense than a material of the first bottom section; and locating the insert in the first aperture to be:

bounded by the second bottom section; and exposed to internal and external sides of the bottom portion.

* * * * *